US006546997B2

(12) United States Patent
Inaba et al.

(10) Patent No.: US 6,546,997 B2
(45) Date of Patent: Apr. 15, 2003

(54) CONDENSER ASSEMBLY STRUCTURE

(75) Inventors: Hiroyuki Inaba, Tokyo (JP); Toru Asanuma, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/929,071

(22) Filed: Aug. 15, 2001

(65) Prior Publication Data

US 2002/0023736 A1 Feb. 28, 2002

Related U.S. Application Data

(62) Division of application No. 08/996,519, filed on Dec. 23, 1997.

(30) Foreign Application Priority Data

| | | |
|---|---|---|
| Dec. 25, 1996 | (JP) | 8-345729 |
| Dec. 26, 1996 | (JP) | 8-346900 |
| Feb. 3, 1997 | (JP) | 9-20238 |
| Feb. 7, 1997 | (JP) | 9-24852 |

(51) Int. Cl.[7] ..... F25B 39/04; F28F 9/02
(52) U.S. Cl. ..... 165/110; 165/173; 165/178
(58) Field of Search ..... 165/110, 173, 165/174, 176, 178

(56) References Cited

U.S. PATENT DOCUMENTS

| | | | | |
|---|---|---|---|---|
| 1,847,743 A | | 3/1932 | Anderson | |
| 4,243,094 A | | 1/1981 | Woodhull, Jr. et al. | 165/114 |
| 4,248,296 A | | 2/1981 | Jezek | 165/118 |
| 4,513,811 A | | 4/1985 | Lesniak | 165/173 X |
| 4,877,083 A | | 10/1989 | Saperstein | 165/176 |
| 4,932,469 A | * | 6/1990 | Beatenbough | 165/153 |
| 5,042,578 A | * | 8/1991 | Tanabe | 165/174 |
| 5,069,277 A | | 12/1991 | Nakamura et al. | 165/173 |
| 5,094,293 A | | 3/1992 | Shinmura | 165/178 |
| 5,178,209 A | | 1/1993 | Aoki et al. | 165/110 |
| 5,178,211 A | | 1/1993 | Bauer et al. | 165/153 |
| 5,246,066 A | | 9/1993 | Morgan et al. | 165/173 |
| 5,482,112 A | | 1/1996 | Sasaki et al. | 165/110 |
| 5,526,876 A | * | 6/1996 | Karube | 165/174 |

FOREIGN PATENT DOCUMENTS

| | | | |
|---|---|---|---|
| DE | 88 05 401.2 | 7/1988 | |
| DE | 91 02 265.7 | 6/1991 | F28F/3/14 |
| EP | 583851 | 2/1994 | 165/149 |
| EP | 0 622 599 A2 | 11/1994 | F28D/1/053 |
| EP | A2 0 622 599 | 11/1994 | F28D/1/053 |
| EP | A1 0 633 435 | 1/1995 | F28B/39/04 |
| EP | A2 0 710 811 | 5/1996 | F28F/1/12 |
| FR | 2 681 421 | 9/1992 | F28F/9/18 |
| FR | 2 681 421 | 3/1993 | |
| JP | 4-270896 | 2/1992 | 165/149 |
| JP | 5-93592 | 4/1993 | 165/149 |

OTHER PUBLICATIONS

Patent Abstracts of Japan, vol. 015, No. 411 (M–1170) Oct. 21, 1991 & JP 03 170756A (Showa Alum Corp) Jul. 24, 1991 * abstract*.

* cited by examiner

*Primary Examiner*—Allen Flanigan
(74) *Attorney, Agent, or Firm*—Sughrue Mion, PLLC

(57) ABSTRACT

The condenser assembly structure is disclosed. The opening of the outgoing pipe is positioned below the upper openings of the heat transfer tubes in the inner space of the upper header pipe. Cutouts are formed in the upper ends of heat transfer tubes, which are located within an upper header pipe. A lubricant mixed in a refrigerant is introduced from the inside of the upper header pipe into the heat transfer tubes by way of the cutouts. The outgoing pipe defining is attached to the lower header pipe at a position close to its end. A total passage area of first heat transfer tubes through which the refrigerant flows downward is larger than that of second heat transfer tubes through which the refrigerant flows upward. The total passage area of the second heat transfer tubes is smaller than that of third heat transfer tubes through which the refrigerant flows downward.

3 Claims, 18 Drawing Sheets

CONDENSER ASSEMBLY STRUCTURE

This is a divisional of application Ser. No. 08/996,519 filed Dec. 23, 1997, the disclosure of which is incorporated herein by reference.

BACKGROUND OF THE INVENTION

1. Field of the Invention

The present invention relates to a condenser inserted between a compressor and an evaporator in a vapor compression type refrigerator, which is used for an automobile air conditioner. The condenser receives the refrigerant from the compressor, condenses and liquefies the refrigerant by causing it to radiate heat, and sends the liquefied refrigerant to an evaporator by way of a liquid tank.

2. Description of the Related Art

A vapor compression type refrigerator is incorporated into an automobile air conditioner for cooling and dehumidifying the inside of an automobile. A circuit diagram showing the concept of the vapor compression type refrigerator, disclosed in Japanese Patent Publication No. Hei. 4-95522, is shown in FIG. 14. A compressor 1 discharges a gaseous refrigerant that is high in temperature and pressure to a condenser 2. When passing through the condenser 2, a heat exchanging is performed between the refrigerant and air. The gaseous refrigerant drops in temperature and is condensed into a liquid refrigerant. The liquid refrigerant is temporarily impounded in a liquid tank 3. Then, it is sent through an expansion valve 4 to an evaporator 5 where it is evaporated. Temperature of the evaporator 5 drops because the evaporator loses the latent heat of vaporization. Therefore, when air for air conditioning is circulated through the evaporator 5, the air is cooled and dehumidified. The refrigerant is evaporated into a gaseous refrigerant in the evaporator 5, and is sucked by and into the compressor 1, and compressed again therein. In this way, the refrigerating cycle is repeated.

FIG. 15 shows a condenser 2 to which the present invention is applied. As shown, the condenser 2 includes a couple of upper and lower header pipes 6*a* and 6*b* arranged horizontally and in parallel. Refrigerant vertically flows between the upper and lower header pipes 6*a* and 6*b*. The condenser 2 is of the so-called vertical flow type. Attempts have been made to use fins for the cores of both the condenser 2 and a radiator 26 located adjacent to the condenser, and thereby realize a compact assembly of the condenser 2 and the radiator 26. One or more partitioning walls are provided within the header pipes 6*a* and 6*b* of the condenser 2, whereby the inner parts of the header pipes 6*a* and 6*b* are air- and liquid-tightly partitioned into a plural number of chambers. The inner part of the upper header pipe 6*a* is partitioned, by an upper partitioning wall 13, into a first upper chamber 15 and a second upper chamber 16. The inner part of the lower header pipe 6*b* is partitioned, by a lower partitioning wall 14, into a first lower chamber 17 and a second lower chamber 18. In the core 9 of the condenser 2, a plural number of heat transfer tubes 7 are vertically arranged between the upper and lower header pipes 6*a* and 6*b*. Fins 8 are located between and supported by the heat transfer tubes 7 located adjacent to each other. Those heat transfer tubes 7 are classified into three types of heat transfer tubes, first heat transfer tubes 19, second heat transfer tubes 20, and third heat transfer tubes 21. The first heat transfer tubes 19 are opened at the upper ends into the first upper chamber 15, and at the lower ends into the first lower chamber 17. The second heat transfer tubes 20 are opened at the upper ends into the second upper chamber 16, and at the lower ends into the first lower chamber 17. The third heat transfer tubes 21 are opened at the upper ends into the second upper chamber 16, and at the lower ends into the second lower chamber 18. The heat transfer tubes 7 are grouped into the first to third heat transfer tubes 19, 20 and 21 with respect to the upper and lower partitioning walls 13 and 14. The first heat transfer tubes 19 are located most upstream in the core, and feed the refrigerant downward. The second heat transfer tubes 20 are located at the central portion of the core, and feed the refrigerant upward. The third heat transfer tubes 21 are located most downstream in the core, and feed the refrigerant downward. Side plates 10*a* and 10*b* are located on both sides of the core 9 including the heat transfer tubes 7 and the fins 8.

The first, second and third heat transfer tubes 19, 20 and 21 are different in number. A total passage area S19 of the first heat transfer tubes 19 is larger than a total passage area S20 of the second heat transfer tubes 20, and the total passage area S20 is larger than a total passage area S21 of the third heat transfer tubes 21. That is, S19>S20>S21. (However, in the case of a condenser 2 shown in FIG. 16, S19=520=S21, and the first, second and third heat transfer tubes 19, 20 and 21 are equal in number.) That is, the total passage area of one group (upward group or downward group) of the heat transfer tubes is generally decreased as the refrigerant flows downward because the refrigerant is more condensed as flowing downward so that the volume of the refrigerant is more decreased.

An incoming block 11 is brazed to the upper side of right end (in FIG. 15) of the upper header pipe 6*a*. The incoming block 11 includes incoming ports 12 continuous to the inside of the first upper chamber 15. Refrigerant that comes in through the incoming ports 12 flows vertically between the upper and lower header pipes 6*a* and 6*b* in the direction of arrows in FIG. 15.

An outgoing pipe 22 through which the refrigerant goes out is firmly attached to the lower side of the left end (in FIG. 15) of the lower header pipe 6*b*, viz., the lower surface of the leftmost chamber (second lower chamber 18) located most downstream in the condenser. The upper end of the outgoing pipe 22 is opened into the second lower chamber 18 at a position close to the lower partitioning wall 14. The refrigerant flows into the condenser 2, flows through the condenser 2 in the direction of the arrows (FIG. 15), and reaches the second lower chamber 18 of the lower header pipe 6*b*. Then, the refrigerant goes out of the outgoing pipe 22, flows through the liquid tank 3 and the expansion valve 4, and goes to the evaporator 5 (FIG. 14). In FIG. 16, the outgoing pipe 22 is omitted.

In the inner part of the thus constructed condenser 2, refrigerant that comes in from the compressor 1 (FIG. 14) flows while being condensed into a liquid refrigerant. Specifically, the refrigerant comes in the condenser 2 through the incoming ports 12, and as it is passed through the condenser 2, heat exchange is carried out between the refrigerant and air that flows through the core 9 in the direction from one side to the other side of the core 9, thereby dropping the temperature of the refrigerant. Thus, the gaseous refrigerant comes in the condenser 2 and is separated into a liquid refrigerant and a gaseous refrigerant. Therefore, the liquid refrigerant and the gaseous refrigerant coexist in the third heat transfer tubes 21.

FIG. 17 shows another example of the conventional condenser 2. In this condenser, the outgoing pipe 22 is attached to the upper side of the left end of the upper header pipe 6*a*, viz., the upper surface of the leftmost chamber located most downstream in the condenser. That is, two upper partitioning walls 13 are provided in the upper header pipe 6*a*.

In the condenser 2 shown in FIG. 17, the outgoing pipe 22 is inserted into the upper header pipe 6*a* through a connection hole 30, which is formed in the upper side of the upper header pipe 6*a*, and is opened into the upper header pipe 6*a*. The outer circumferential surface of the outgoing pipe 22 is air- and liquid-tightly coupled with the inner circumferential edge of the connection hole 30 by brazing as shown in FIG. 18. The upper ends of the heat transfer tubes 7 are inserted into the upper header pipe 6*a* through the connection hole 31 formed in the lower side of the upper header pipe 6*a*. The upper opening 33 of each heat transfer tube 7 is positioned at the middle of the upper header pipe 6*b* when viewed in cross section. When an amount of the liquid refrigerant staying in the upper header pipe 6*a* is small (at high load), a liquid level L1 of the liquid refrigerant is below the opening 32 of the outgoing pipe 22 (FIG. 18). When the liquid refrigerant is large (at low load), a liquid level L2 of the refrigerant reaches the opening 32 of the outgoing pipe 22.

Here, the term "high load" means that a difference between a set temperature in the air conditioner and an actual temperature in the car is large, and the refrigerant frequently circulates in the air conditioner. The term "low load" means that a difference between the set temperature and the actual temperature is small, and the refrigerant infrequently circulates in the air conditioner.

When the amount of liquid refrigerant staying in the upper header pipe 6*a* is small, the liquid level L1 of the refrigerant is below the opening 32 of the outgoing pipe 22. Therefore, no refrigerant flows into the outgoing pipe 22. The result is that the amount of the liquid refrigerant fed from the condenser 2 to the expansion valve 4 is reduced, temperature drop of the evaporator 5 (FIG. 14) is small, and hence the air conditioner exhibits insufficiently its cooling capability.

When the liquid refrigerant staying in the upper header pipe 6*a* is large in amount, the liquid level L2 of the refrigerant is above the opening 32 of the outgoing pipe 22. The air conditioner does not suffer from the above problem, but suffers from the following problem. Since the liquid level L2 of the refrigerant increases above the upper openings 33 of each heat transfer tube 7, the refrigerant that has ascended through the heat transfer tubes 7 flows into the upper header pipe 6*a* while pushing aside the liquid refrigerant that stays in the upper header pipe 6*a*. Since a viscosity of the liquid refrigerant is larger than that of the gaseous refrigerant, the liquid refrigerant exhibits a large resistance to the thrust by the gaseous refrigerant. Therefore, when the refrigerant ascends through the heat transfer tubes 7 and flows into the upper header pipe 6*a*, it undergoes an increased impedance. In other words, a resistance of the condenser 2 is increased. The increase of the resistance of the condenser 2 leads to degradation of the performances of the vapor compression type refrigerator having the condenser 2 incorporated therein.

Further, a lubricant is mixed into the refrigerant to lubricate the compressor. In the conventional condensers constructed as aforementioned, the lubricant tends to gather in the condenser 2, thereby lessening the amount of lubricant that circulates through the refrigerating cycle in the vapor compression type refrigerator. The lubricant mixed into the refrigerant circulates, together with the refrigerant, through the refrigerating cycle in the refrigerator while lubricating the compressor. The opened, upper ends of the heat transfer tubes 7 of the core 9 of the condenser 2 are protruded into the inside of the upper header pipe 6*a* and their tips are positioned at the mid position therein when viewed in cross section (FIGS. 19 and 20).

The lubricant 34 that is mixed into the refrigerant flows into the upper header pipe 6*a* and tends to be gathered on the bottom of the upper header pipe 6*a*. The lubricant mixed into the refrigerant will gradually be separated from the refrigerant with time. After being separated from the refrigerant in the upper header pipe 6*a*, the lubricant 34 (in FIGS. 19 and 20) is gathered in the space between the bottom surface of the upper header pipe 6*a* and the upper end openings of the heat transfer tubes 7, viz., on the bottom of the upper header pipe 6*a*. The lubricant 34 that is gathered on the bottom of the upper header pipe 6*a* only flows a little in the direction of flow of refrigerant. Therefore, the amount of the lubricant 34 that circulates through the refrigerating cycle in the vapor compression type refrigerator is reduced by the amount of the lubricant gathered on the bottom of the upper header pipe 6*a*. In an extreme case, the amount of the lubricant 34 that circulates through the refrigerating cycle in the vapor compression type refrigerator is reduced below a necessary amount thereby impairing the durability of the compressor.

The durability impairing problem may be solved by increasing an amount of lubricant put into the refrigerating cycle by an amount equal to the amount of the lubricant that will be gathered on the bottom of the upper header pipe 6*a*. However, increasing the lubricant amount creates another problem; films of the lubricant tend to be formed on the inner surfaces of the heat transfer tubes which form a heat exchanger (including the evaporator and the condenser). Presence of the lubricant films on the heat transfer tubes hinders the heat exchanging between the refrigerant flowing through the heat transfer tubes and the heat transfer tubes. The result is that the performance of the heat exchanger is degraded. The increase of the lubricant amount further increases the cost to manufacture a vapor compression type refrigerator having the condenser 2 incorporated therein.

To reduce the amount of the lubricant 34 gathered on the bottom of the upper header pipe 6*a*, a structure as shown in FIGS. 21 and 22 has been proposed. In the structure, the bottom of the upper header pipe 6*a* is flat. A protrusion of the upper ends of the heat transfer tubes 7 from the flat bottom 35 is reduced. However, the structure suffers from the following problems. In this structure, the bottom 35 is large in area and a depth of the gathered lubricant 34 is not large, but the amount of the lubricant 34 gathered on the bottom of the upper header pipe 6*a* is increased. When the flat bottom 35 receives a high pressure refrigerant that is fed to the upper header pipe 6*a*, it is easily deformed. Therefore, where this structure is used, it is difficult to make a good comprise between high durability and reduction of the condenser weight by thinning the upper header pipe 6*a*.

There is another problem with the condenser shown in FIG. 15. The lower end openings of the third heat transfer tubes 21, which are located closer to the center (closer to the right-hand side in FIG. 15) of the core 9, are confronted with the upper end opening of the outgoing pipe 22. Therefore, an increased amount of the liquid refrigerant tends to flow through those third heat transfer tubes 21 closer to the core center. The reason for this is as follows. The liquid refrigerant that flows toward the left end (in FIG. 15) of the upper header pipe 6*a* in the second upper chamber 16 will flow downward by its weight. As a result, an increased amount of the liquid refrigerant flows into the third heat transfer tubes 21 that are located closer to the center of the core 9. The liquid refrigerant that flows into the third heat transfer tubes 21 directly reaches the upper end opening of the outgoing pipe 22, and is discharged out of the condenser 2. Meanwhile, the gaseous refrigerant is in a high velocity of flow, and less affected by its weight. Therefore, the gaseous refrigerant reaches the end of the second upper chamber 16 that is located downstream in the core, and flows downward through the third heat transfer tubes 21 (laid out in the cross-hatched portion in FIG. 15) located close to the left end of the core 9, and reaches the left end portion (in FIG. 15) of the second lower chamber 18. The gaseous refrigerant then flows to the center in the second lower chamber 18, and goes out of the condenser 2, through the outgoing pipe 22.

If the liquid refrigerant and the gaseous refrigerant that pass through the third heat transfer tubes 21 are mixed in the second lower chamber 18 and go out of the outgoing pipe 22, no problem arises in particular. The gaseous refrigerant that reaches the left end of the second lower chamber 18, swiftly moves to a portion near to the upper end of the outgoing pipe 22. Sometimes, the gaseous refrigerant is obstructed by the liquid refrigerant temporarily staying at a portion close to the right end of the second lower chamber 18, and fails to reach the upper end opening of the outgoing pipe 22. The gaseous refrigerant that fails to reach the upper end opening of the outgoing pipe 22 stays in the second lower chamber 18, thereby collecting an excess amount of gaseous refrigerant. Then, the gaseous refrigerant rushes into the outgoing pipe 22 because of its increased pressure. Where this phenomenon is repeated, only the liquid refrigerant and the mixture of the liquid refrigerant and the gaseous refrigerant are alternatively discharged through the outgoing pipe 22. The refrigerant discharging operation from the outgoing pipe 22 is thus instable. The result impair the temperature control function of the automobile air conditioner.

Further, there is still another problem in the condenser in FIGS. 15 and 16.

The lubricant tends to gather at a portion B (shaded in FIGS. 15 and 16) within the lower header pipe 6*b*. Portion B is close to the lower partitioning wall 14 which partitions the inner space of the lower header pipe 6*b* into the first lower chamber 17 and the second lower chamber 18. The reason for this is that after flowing through the first heat transfer tubes 19 into the first lower chamber 17, the refrigerant flows to the second heat transfer tubes 20 while pushing the lubricant against the lower partitioning wall 14. The refrigerant then flows upward through the second heat transfer tubes 20. If the flow velocity of the refrigerant flowing through the first lower chamber 17 to the lower partitioning wall 14 is sufficiently large, it pushes the lubricant into the second heat transfer tubes 20. In the structure of either condenser of FIGS. 15 and 16, the flow velocity is not sufficiently large. Therefore, when the refrigerant flows upward through the second heat transfer tubes 20, the lubricant mixed into the refrigerant remains in the vicinity of the lower partitioning wall 14. The amount of lubricant fed to the compressor is reduced by the amount of lubricant staying in the condenser 2, and deficient. This problem frequently arises particularly when the amount of the refrigerant discharged out of the compressor is small and a reduced amount of the refrigerant flows through the condenser 2, for example, when the engine is idling, and when the compressor of the variable capacity type is reduced in its capacity.

SUMMARY OF THE INVENTION

Accordingly, an object of the present invention is to solve the problems of the conventional condensers described above.

First, the basic construction of the condenser assembly structure to which the present invention is applied, comprises: an upper header pipe arranged horizontally; a lower header pipe arranged parallel to the upper header pipe; a plural number of heat transfer tubes arranged vertically between the upper and lower header pipes, upper and lower ends of the heat transfer tubes being opened into inner parts of the upper and lower header pipes.

According to a first aspect of the invention, an outgoing pipe is coupled with the upper header pipe. Refrigerant flows through the upper and lower header pipes, the heat transfer tubes and then flows out through the outgoing pipe. An opening of the outgoing pipe is positioned below the upper opening of the heat transfer tubes in the inner space of the upper header pipe.

The opening of the outgoing pipe, which is coupled with the upper header pipe, is positioned below the upper openings of the heat transfer tubes horizontally adjacent to each other. The opening of the outgoing pipe is lower than the liquid level of the liquid refrigerant in the upper header pipe even when the liquid refrigerant staying on the upper header pipe is relatively small, whereby the liquid refrigerant can be fed into the outgoing pipe. Further, the upper openings of the heat transfer tubes are always higher than the liquid level of the liquid refrigerant staying on the upper header pipe.

Therefore, the liquid refrigerant staying in the upper header pipe does not resist a flow of the refrigerant that is discharged from the heat transfer tubes into the upper header pipe. Thus, the fluid resistance of the condenser is set at a low value of resistance. Where the tip of the outgoing pipe is abutted against the bottom of the upper header pipe, the support of the outgoing pipe by the upper header pipe is more reliable.

According to a second aspect of the invention, a fluid passage is formed at an upper end of at least one of the heat transfer tubes, the fluid passage is located below the upper end of the heat transfer tube and just above an inner bottom portion of the upper header pipe so as to guide a fluid staying at the inner bottom portion of the upper header pipe into the heat transfer tube.

In the thus constructed condenser, a fluid passage is formed in the upper part of at least one heat transfer tube. Therefore, the lubricant staying on the bottom of the upper header pipe is introduced through the passage and into the heat transfer tube having the passage. The fluid flows downward through the heat transfer tube to the lower header pipe. Thus, not much lubricant stays on the bottom of the upper header pipe. Therefore, the amount of the lubricant circulating in the vapor compression type refrigerator with the condenser incorporated therein is increased correspondingly. The shape of the cross section of the upper header pipe remains circular. Therefore, enough pressure resistance of the upper header pipe is ensured even if the upper header pipe is thinned.

According to a third aspect of the invention, a refrigerant flows through the upper and lower header pipes and the heat transfer tubes and flows out through an outgoing port formed at a position in the lower header pipe close to the end thereof that is located most downstream in a direction of flow of a refrigerant flowing in the lower header pipe.

Thus, in the condenser, the outgoing pipe defining the outgoing port is provided at a position on the lower header pipe close to the end thereof. Therefore, there is no chance that liquid refrigerant that has flowed down through some of the heat transfer tubes of the core will directly reach the upper end opening of the outgoing pipe, or that only the liquid refrigerant will flow into the outgoing pipe. The liquid refrigerant delivered from some of the heat transfer tubes and the gaseous refrigerant delivered from the remaining heat transfer tubes are mixed with each other when they flow through the lower header pipe to the outgoing pipe. Therefore, so long as the refrigerant that reaches the end of the condenser located most downstream in the direction of a refrigerant flow is a mixture of the liquid refrigerant and the gaseous refrigerant, the mixture always flows into the outgoing pipe. The result is that the discharging operation of the refrigerant is stabilized.

According to a fourth aspect of the invention, a total passage area of one group of the upward-flow heat transfer tubes is equal to or smaller than a total area of one group of the downward-flow heat transfer tubes which is located more downstream than the one group of upward-flow heat transfer tubes.

In the condenser, the structure thereof forcibly flows the refrigerant from the lower header pipe to the upper header pipe. Therefore, the lubricant as well the refrigerant is efficiently fed into the heat transfer tubes.

DETAILED DESCRIPTION OF THE PREFERRED EMBODIMENTS

1st Embodiment

Figure 1:
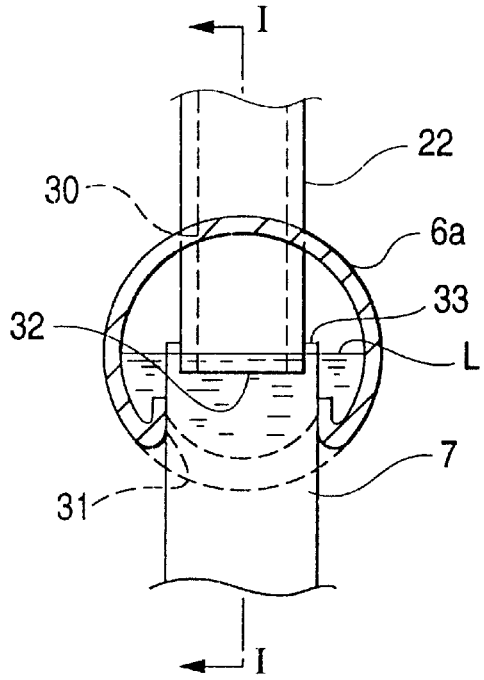
FIG. 1 is a cross sectional view taken along line V—V in FIG. 17, showing a jointing structure including an outgoing pipe, upper header pipe, and heat transfer tube, which constitutes a first embodiment of the present invention.
Figure 2:
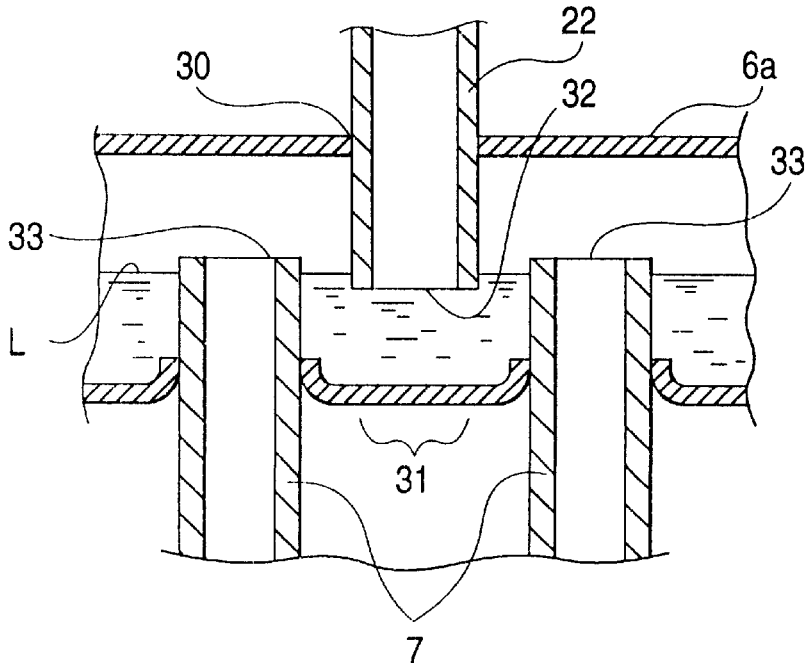
FIG. 2 is a cross sectional view taken along line I—I in FIG. 1.
Figure 15:
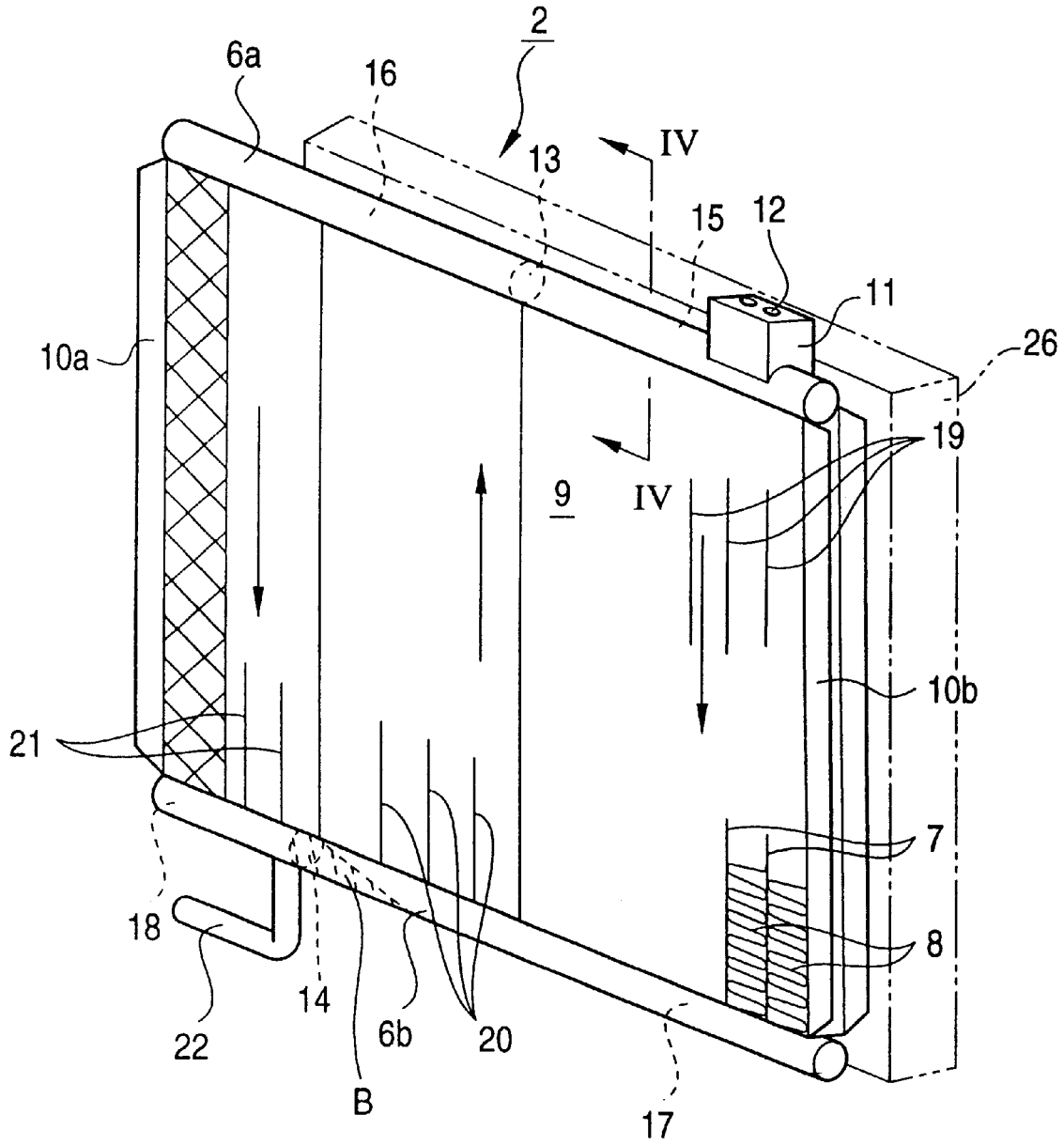
FIG. 15 is a perspective view showing an example of the conventional condenser.
Figure 16:
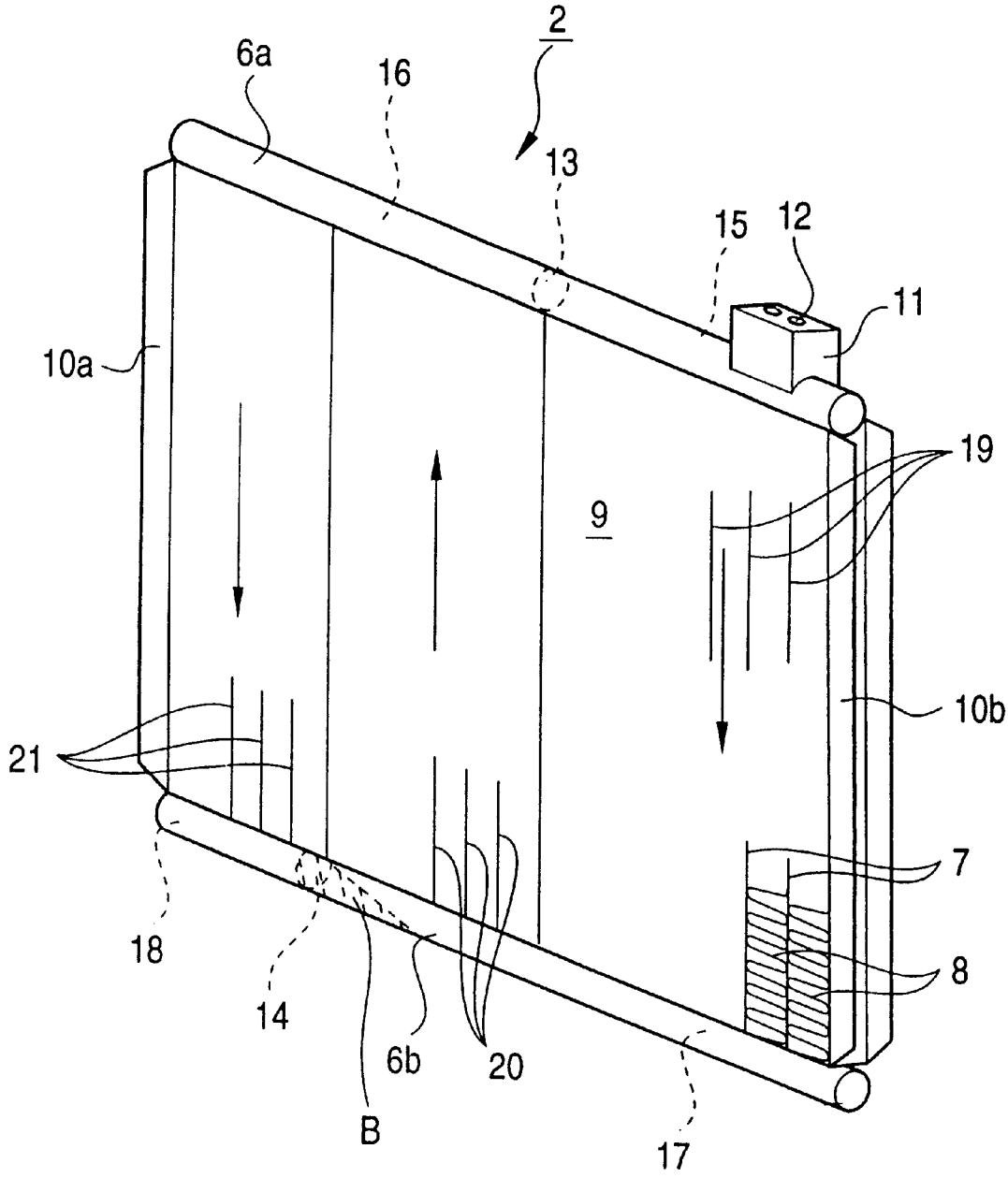
FIG. 16 is a perspective view showing another conventional condenser.

FIGS. 1 and 2 cooperatively show a first embodiment of the present invention. A basic construction of the condenser to which the invention is applied is substantially the same as that of the conventional condensers as shown in FIGS. 15 and 16. The condenser constructed according to the invention is different from the conventional one in a relative position of the opening 32 of the outgoing pipe 22, which is coupled with the upper header pipe 6*a*, to the upper openings 33 of the heat transfer tubes 7 horizontally adjacent to each other. Description which follows will be given putting emphasis on the different portion of the present embodiment while using like reference numerals for designating like or equivalent portions in the conventional condenser.

As shown, while the upper openings 33 of the heat transfer tubes 7 are located substantially in the middle of the inner space of the upper header pipe 6*a*, the opening 32 of the outgoing pipe 22 is placed in the lower part of the inner space of the upper header pipe 6*a*. Accordingly, the opening 32 of the outgoing pipe 22 is positioned below the upper openings 33 of the heat transfer tubes 7. Since the opening 32 of the outgoing pipe 22 is placed in the lower part of the inner space of the upper header pipe 6*a*, the opening 32 of the outgoing pipe 22 is lower than the liquid level L of the liquid refrigerant in the upper header pipe even when the liquid refrigerant staying on the upper header pipe 6*a* is relatively small. Therefore, it is possible to feed the liquid refrigerant into the outgoing pipe 22 even when the liquid refrigerant staying on the upper header pipe 6*a* is relatively small. Further, the upper openings 33 of the heat transfer tubes 7 are always positioned above the liquid level of the liquid refrigerant staying in the upper header pipe 6*a*. Therefore, the refrigerant flowing upward through the heat transfer tubes 7 always flows into the refrigerant vapor in the upper header pipe 6*a*. Thus, there is no chance that the refrigerant is discharged from the upper openings 33 of the heat transfer tubes 7 into the liquid refrigerant staying in the lower header pipe. In other words, the liquid refrigerant staying in the upper header pipe does not resist a flow of the refrigerant that is discharged from the heat transfer tubes 7 into the upper header pipe 6*a*. Thus, the fluid resistance of the condenser 2 is set at a low value of resistance.

Figure 14:
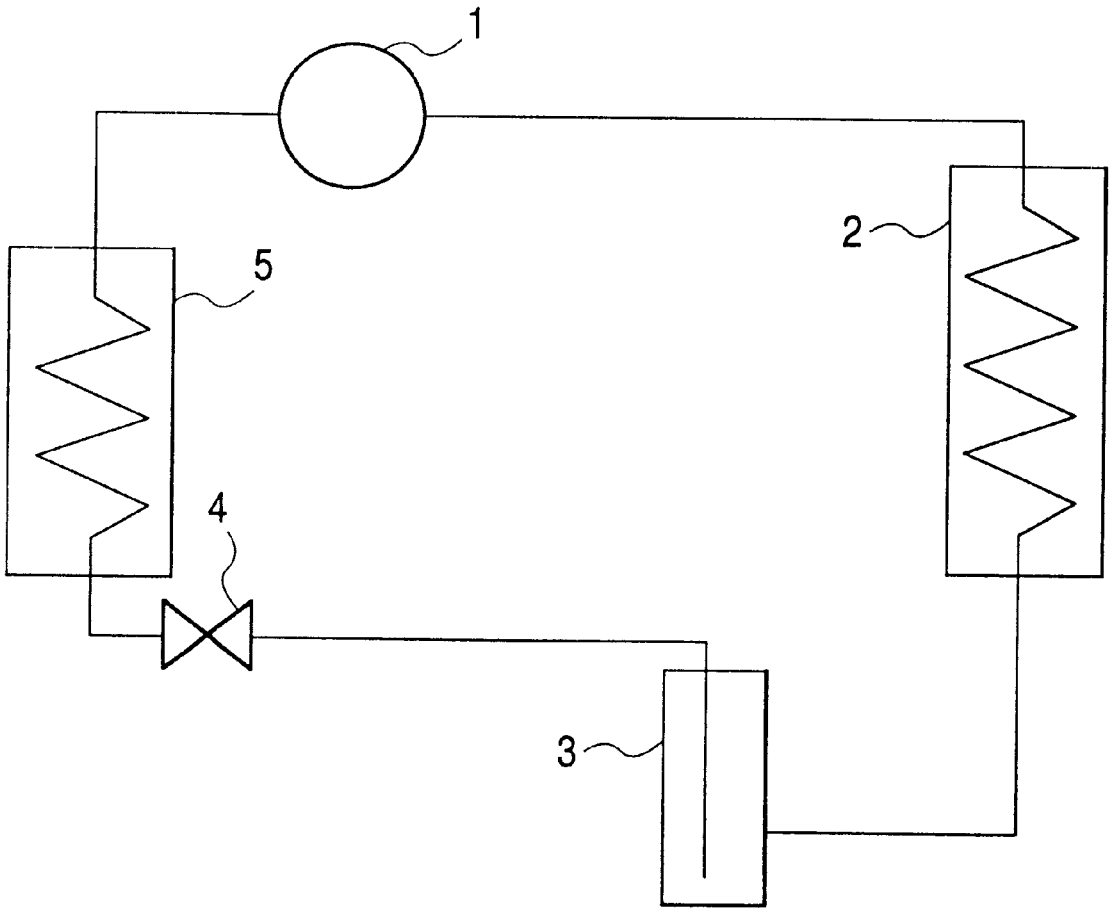
FIG. 14 is a circuit diagram showing a vapor compression type refrigerator having a compressor incorporated there into.
Figure 18:
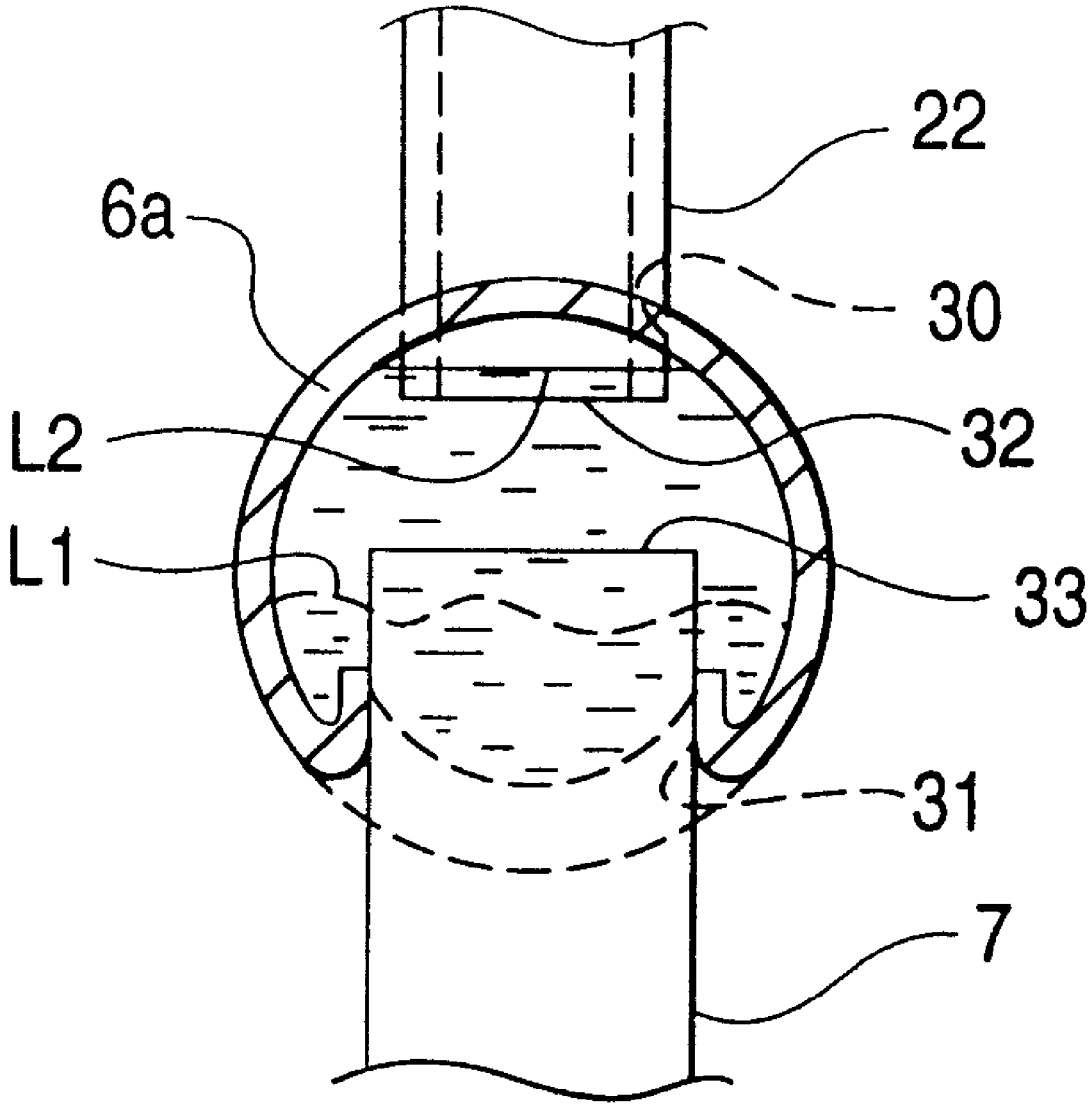
FIG. 18 is a cross sectional view, taken along line V—V in FIG. 17, showing a conventional jointing structure including an outgoing pipe, upper header pipe and a heat transfer tube.
Figure 19:
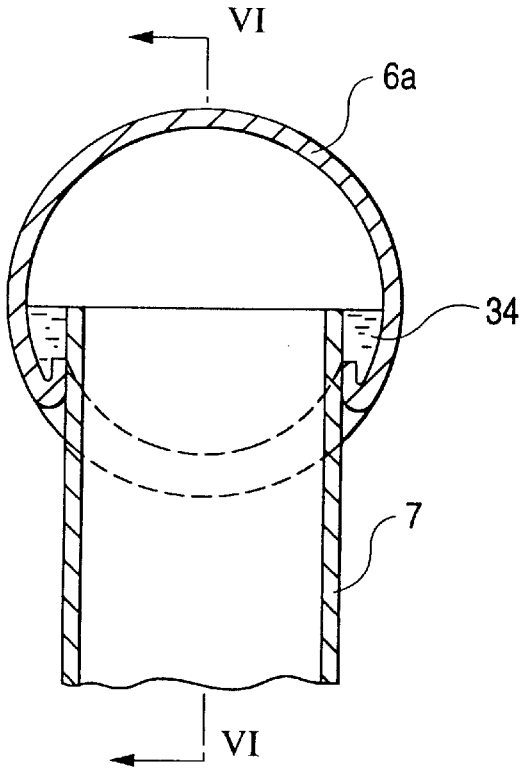
FIG. 19 is a cross sectional view taken along line IV—IV in FIG. 15, the view showing a conventional jointing structure including an upper header pipe and a heat transfer tube.
Figure 20:
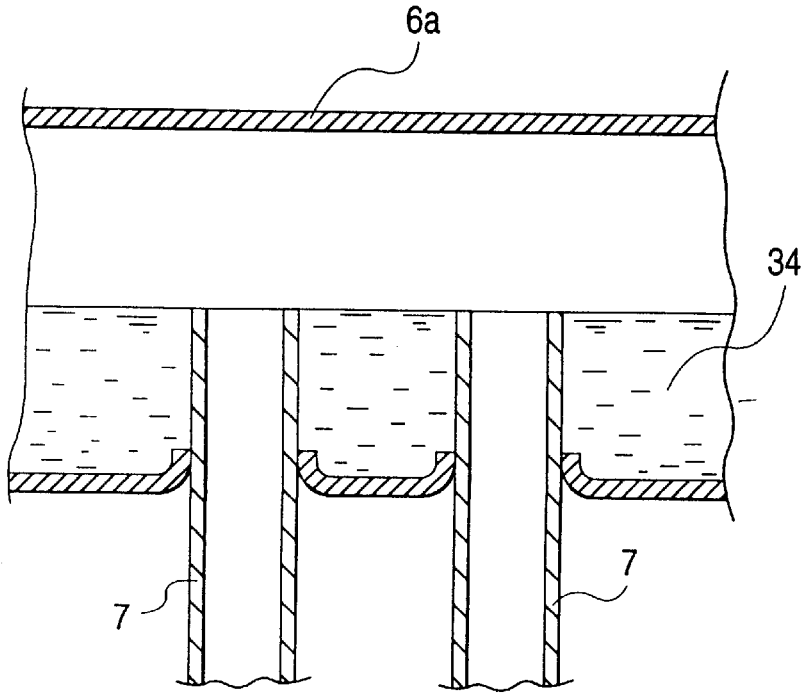
FIG. 20 is a cross sectional view taken along line VI—VI in FIG. 19.
Figure 21:
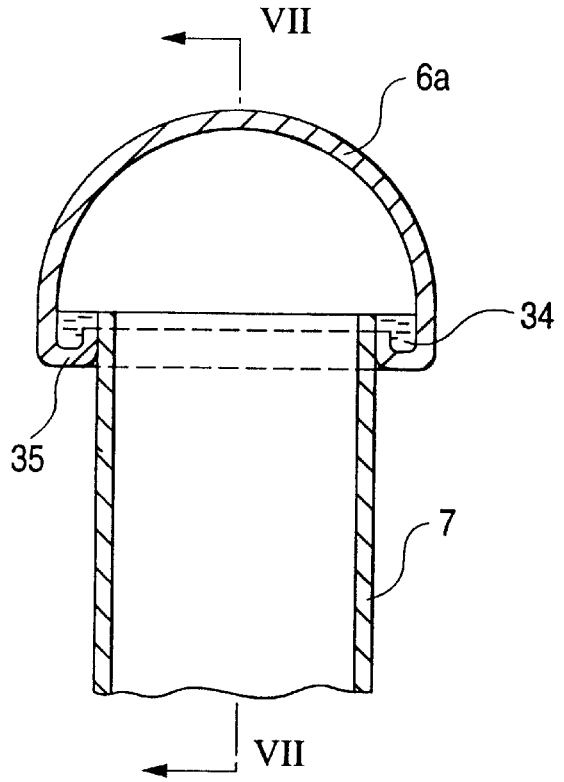
FIG. 21 is a cross sectional view, taken along line IV—IV in FIG. 15, showing another conventional jointing structure including an upper header pipe and a heat transfer tube.
Figure 22:
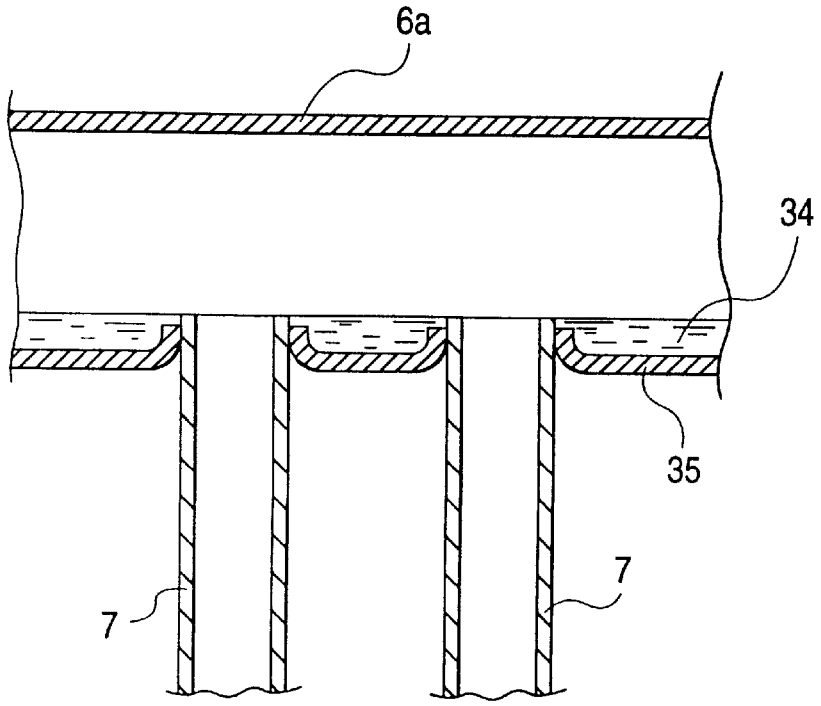
FIG. 22 is a cross sectional view taken along line VII—VII in FIG. 21.

Further, the jointing structure, which includes the outgoing pipe, the lower header pipe and the heat transfer tubes, prevents the lubricant from staying at and near the end of the upper header pipe 6*a* which is located most downstream in the direction of flow of the refrigerant. The lubricant is mixed into the refrigerant passing through the condenser 2 to lubricate the compressor 1 (FIG. 14). A velocity of the refrigerant is decreased at and near the end of the upper header pipe 6*a* which is located most downstream in the direction of flow of the refrigerant since it has been condensed and liquefied, and reduced in its volume. In the jointing structure shown in FIG. 18, the lubricant that has reached the most-downstream end of the upper header pipe 6*a* and its vicinity, stays on the bottom of the upper header pipe 6*a* and is hard to be discharged into the outgoing pipe 22, because of reduction of its fluidity. On the other hand, in the jointing structure of the invention, the lubricant that has reached the most-downstream end of the upper header pipe 6*a* and its vicinity, is efficiently fed into the outgoing pipe 22. The result is that the staying of the lubricant at the most-downstream end of the upper header pipe and its vicinity is lessened to provide a good circulation of the lubricant through the refrigerant cycle in the vapor compression type refrigerator.

2nd Embodiment

Figure 3:
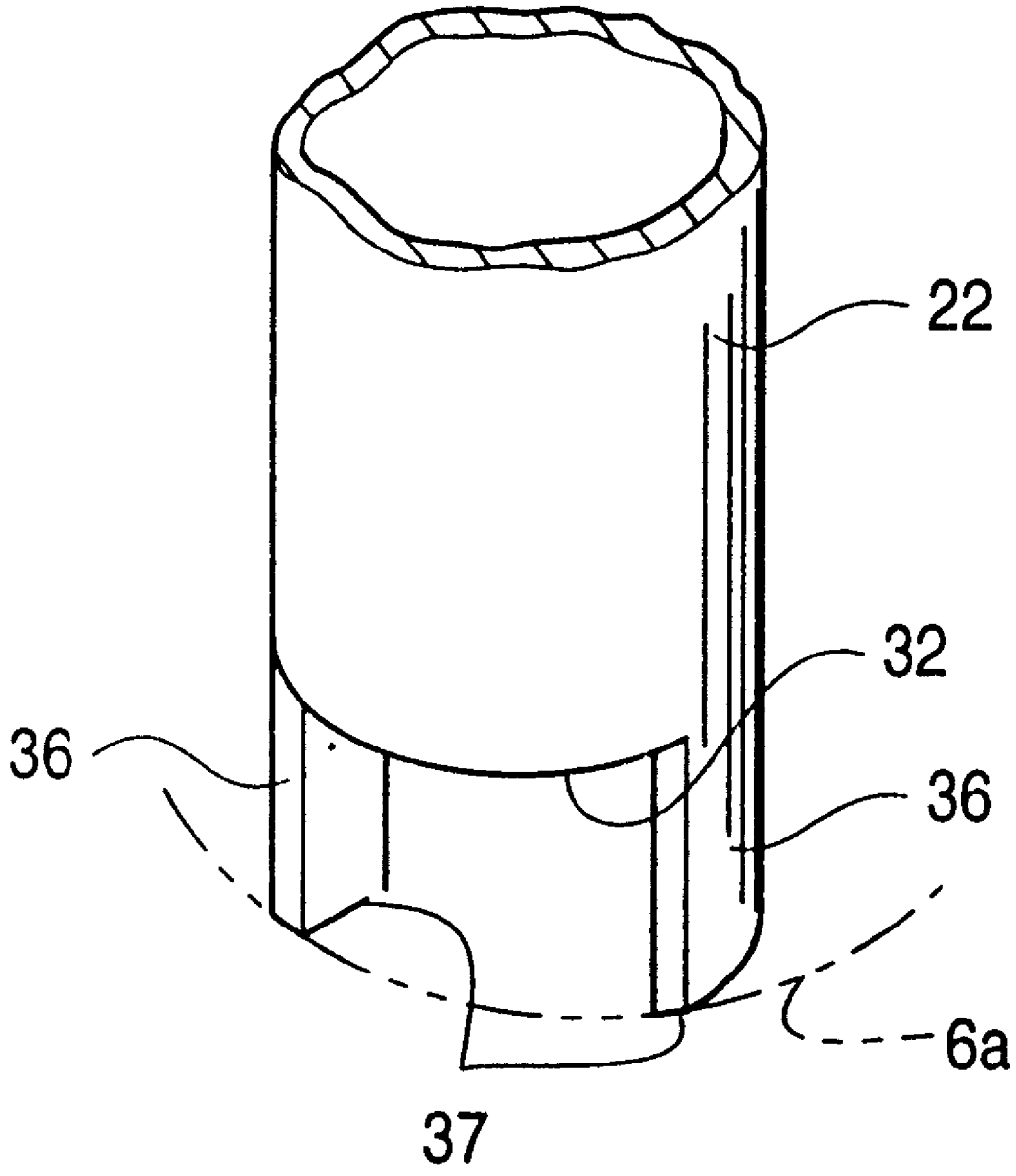
FIG. 3 is a perspective view showing the end of an outgoing pipe used in a second embodiment of the present invention.

FIG. 3 shows a second embodiment of the invention. In the embodiment, a couple of extended portions 36 are axially extended downward from the lower ends of the opening 32 of the outgoing pipe 22. The extended portions 36 are inserted, with their tips 37 first, into the space between the adjacent heat transfer tubes 7 (see FIG. 2) protruded into the inner space of the upper header pipe 6*a*, while being abutted against the corresponding outer sides of the heat transfer tubes 7 on the bottom thereof, and jointed with the latter by hard soldering. While two extended portions 36 are used in the embodiment, the use of at least one extended portion 36 suffices. However, a space large enough to allow the liquid refrigerant to pass therethrough must be secured between the root of the extended portion and the bottom of the upper header pipe 6*a*.

In the jointing structure, the outgoing pipe 22 is fixedly supported at two positions, the inner circumferential edge of the connection hole 30 (FIGS. 1 and 2) of the upper header pipe 6*a* and the bottom of the upper header pipe 6*a*. This ensures a reliable connection of the outgoing pipe 22 to the upper header pipe. The remaining construction and operation of the embodiment are substantially the same as of the first embodiment, and hence the explanation and diagrammatic illustration of them are omitted.

The thus constructed condenser of the invention stably exhibits its refrigerating performances independently of the amount of the refrigerant staying in the upper header pipe, and has a low fluid resistance to the flow of the refrigerant, whereby the performances of the automobile air conditioner is improved.

3rd Embodiment

Figure 4:
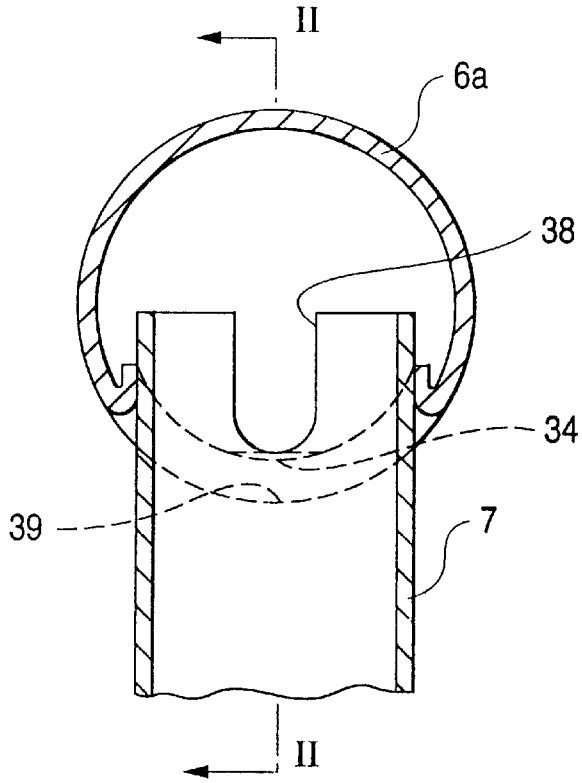
FIG. 4 is a cross sectional view, taken along line IV—IV in FIG. 15, showing a jointing structure including an upper header pipe and a heat transfer tube, which constitutes a third embodiment of the present invention.
Figure 5:
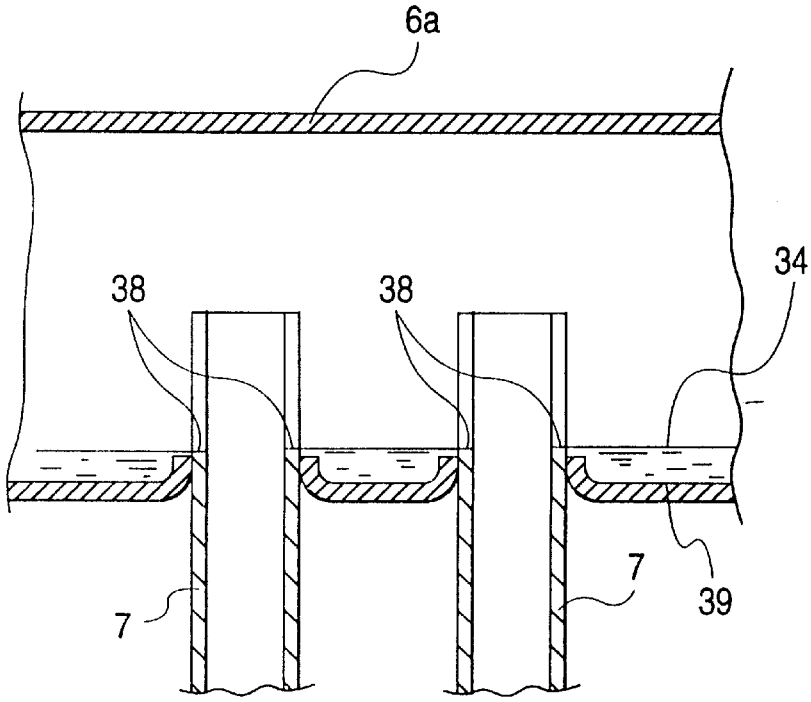
FIG. 5 is a cross sectional view taken along line II—II in FIG. 4.
Figure 17:
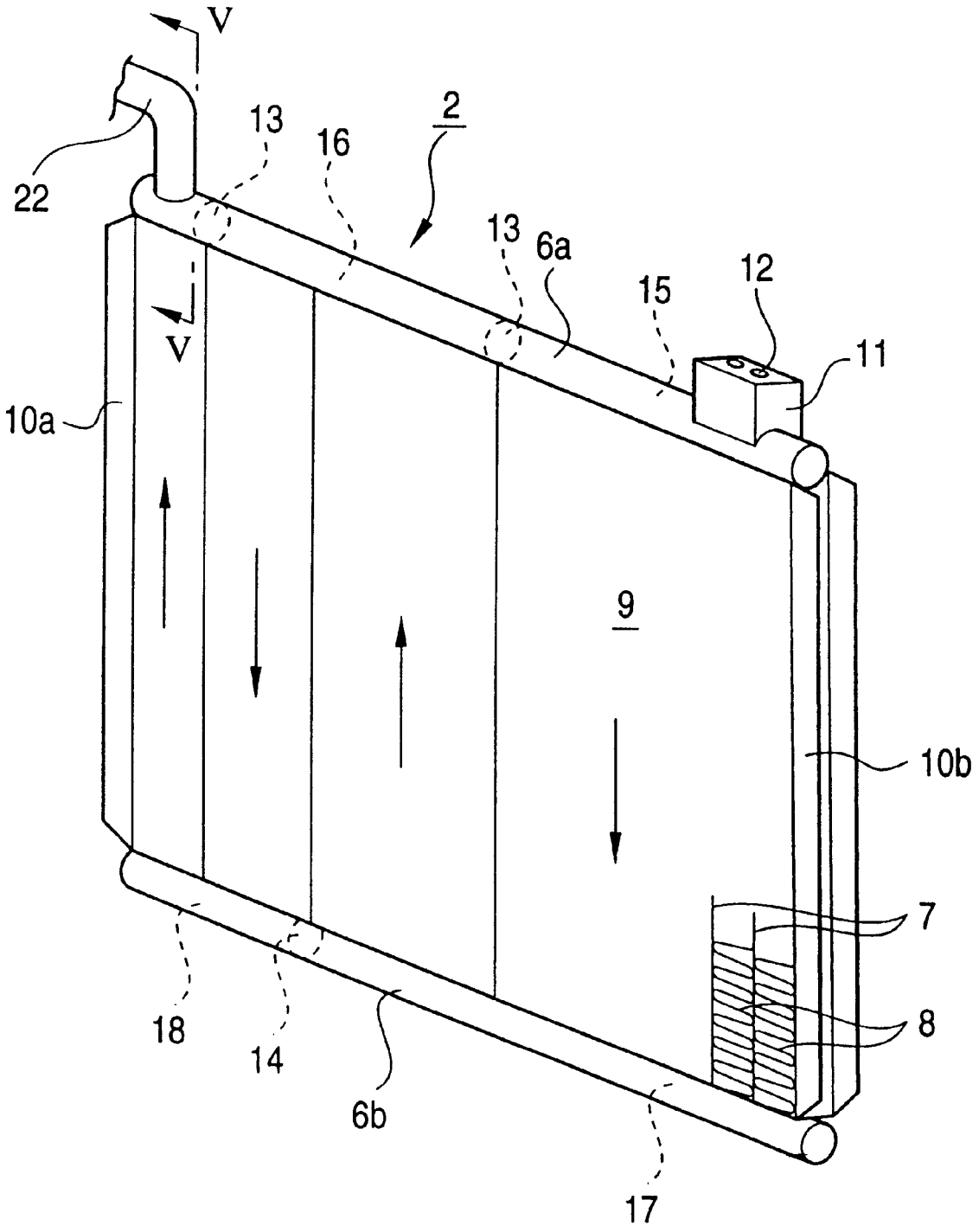
FIG. 17 is a perspective view showing a condenser to which the present invention is directed.

FIGS. 4 and 5 cooperatively show a third embodiment of the present invention. A condenser constructed according to the present invention has advantageous features of securing a satisfactory durability of the upper header pipe 6*a* and reducing an amount of lubricant 34 staying in the upper header pipe 6*a*. A basic construction of the condenser of the embodiment is substantially the same as of the conventional one as shown in FIGS. 15 to 17. Therefore, description which follows will be given putting emphasis on the different portion of the present embodiment while using like reference numerals for designating like or equivalent portions in the conventional condenser.

A plural number of cutouts 38, shaped like U, are formed in the upper ends of a plurality of heat transfer tubes 7, which form a core 9 (FIGS. 15 to 17) of a condenser 2. The bottom of each of the cutouts 38 is located just above the bottom surface 39 of the upper header pipe 6*a*. In this embodiment, the cutouts 38 guide a fluid present on and near the bottom of the upper header pipe 6*a* into the heat transfer tubes 7.

With use of the cutouts 38, the lubricant 34 that has reached the bottom of the upper header pipe 6*a* is introduced into the heat transfer tubes 7 by way of the cutouts 38, and flows downward through the heat transfer tubes 7 to the lower header pipe 6*b* (FIGS. 15 to 17). Since the lower ends of the cutouts 38 are located just above the bottom of the upper header pipe 6*a*, the lubricant 34 that is left in the upper header pipe 6*a* after it flows into the heat transfer tubes 7 through the cutouts 38 is small in amount.

In the condenser of the invention, an amount of lubricant 34 staying on the bottom of the upper header pipe 6*a* is reduced. Therefore, the amount of the lubricant 34 circulating in the vapor compression type refrigerator with the condenser incorporated therein is increased correspondingly. The shape of the cross section of the upper header pipe 6*a* remains circular. Therefore, enough pressure resistance of the upper header pipe 6*a* can be secured even if the upper header pipe 6*a* is thinned. The result is that the weight of the condenser is reduced and the durability thereof is improved.

4th Embodiment

Figure 6:
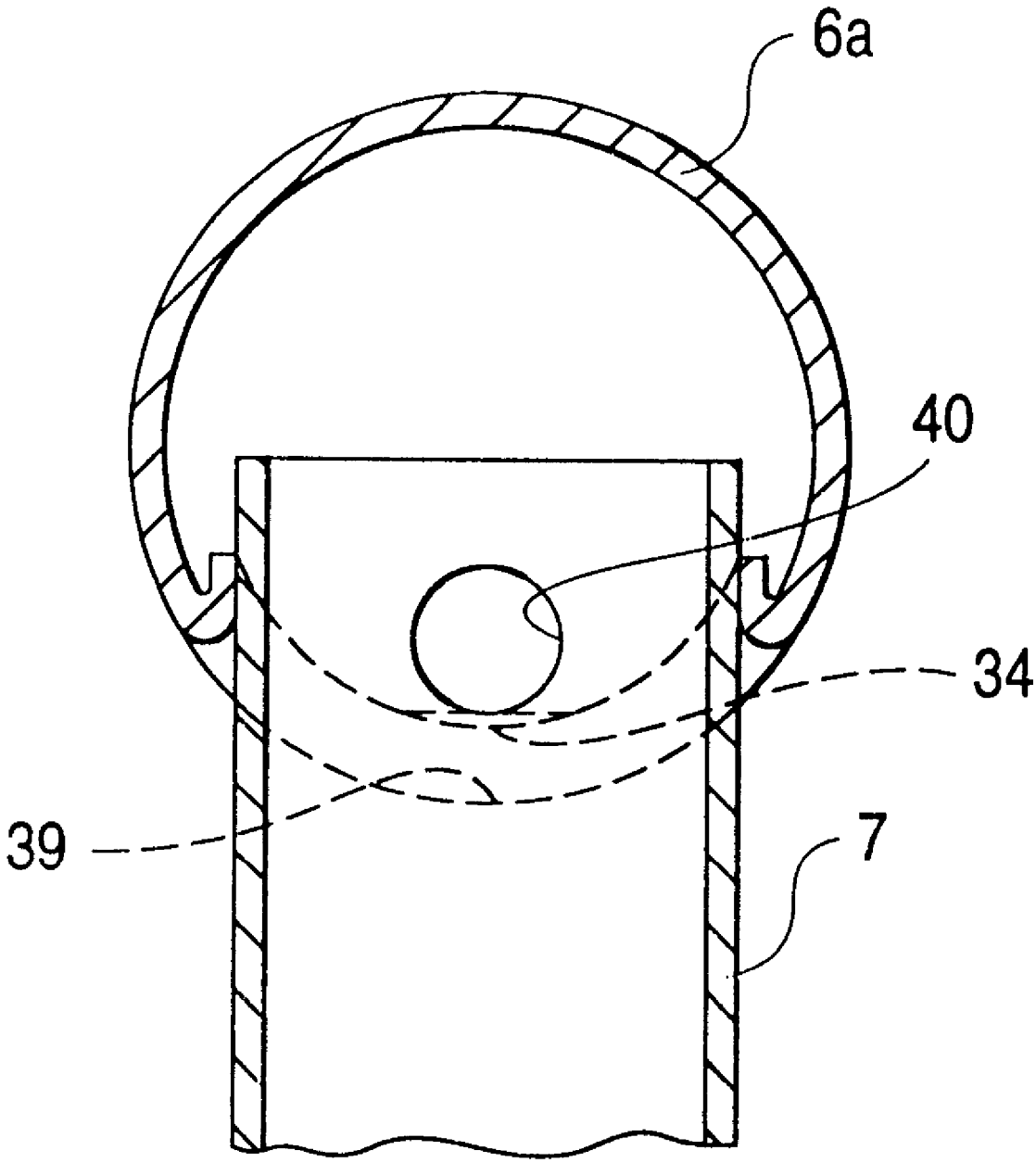
FIG. 6 is a ross sectional view of another jointing structure including an upper header pipe and a heat transfer tube, which constitutes a fourth embodiment of the present invention.

FIG. 6 shows a fourth embodiment of the present invention. A small through-hole 40 is formed in the upper end of each heat transfer tube 7. Specifically, a portion of the upper end of the heat transfer tube 7 where the small through-hole 40 is formed is located below the opening of the upper end and just above the bottom surface 39 of the upper header pipe 6*a*. The small through-holes 40 of the heat transfer tubes guide a fluid staying on the bottom of the upper header pipe 6*a* into the heat transfer tubes 7. The amount of lubricant 34 staying in the upper header pipe 6*a* is reduced, as in the third embodiment.

In the embodiments mentioned above, the cutouts 38 or the small through-holes 40 are formed in all the heat transfer tubes 7 forming the core 9. The cutouts 38 or the small through-holes 40 are not necessarily formed in all the heat transfer tubes 7. The number of the cutouts 38 or the small through-holes 40, which is large enough to prevent much lubricant 34 from staying on the bottom of the upper header pipe 6*a*, will do for the invention. For this reason, the cutouts 38 or the small through-holes 14 may be formed only in the heat transfer tubes 7 for guiding the fluid from the upper header pipe 6*a* to the lower header pipe 6*b*.

The cutouts 38 or the small through-holes 40 are not necessarily formed in all the heat transfer tubes 7 for guiding the fluid from the upper header pipe 6*a* to the lower header pipe 6*b*. For example, the cutout 38 or the small through-hole 40 may be formed only in one of the heat transfer tubes 7, which guides the fluid from the upper header pipe 6*a* to the lower header pipe 6*b* and opened at their upper ends into a chamber in the upper header pipe. This example is able to prevent much lubricant 34 from staying on the bottom of the upper header pipe 6*a*.

Since the condenser of the invention is thus constructed and operated, the contradictive aims of the reducing of the weight and the improving of the durability are well compromised. Therefore, the invention realizes an automobile air conditioner of high performances and at low cost.

5th Embodiment

Figure 7:
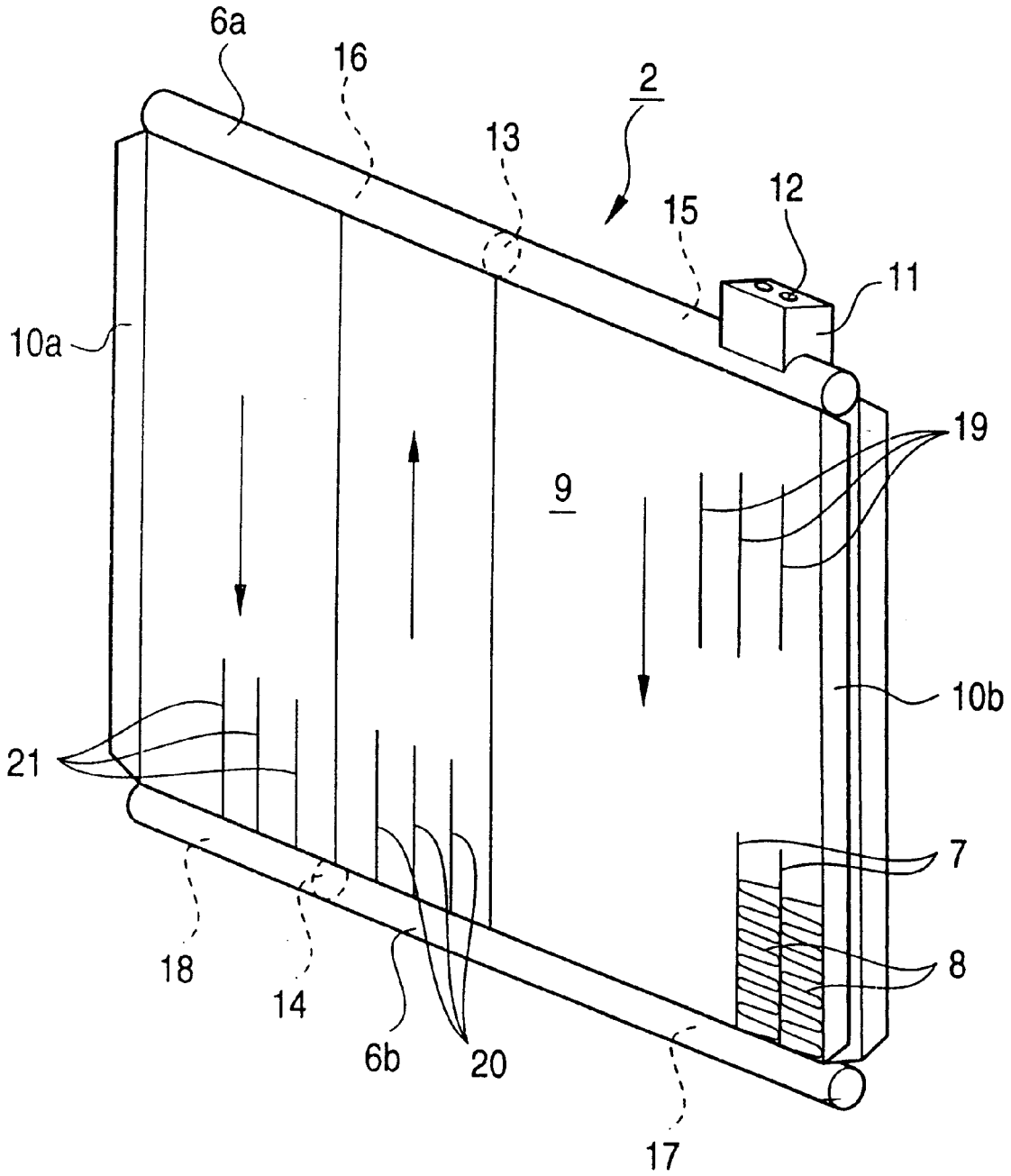
FIG. 7 is a perspective view showing a condenser which is a fifth embodiment of the present invention.

FIG. 7 shows a condenser which is a fifth embodiment of the present invention. The basic construction of the condenser that is designated by reference numeral 2 and constructed according to the concept of the invention is substantially the same as that of the conventional one as shown in FIGS. 15 and 16 except that the positions of the walls for partitioning the upper and lower header pipes are different from those of the conventional one.

As shown in FIG. 7, the condenser 2 of the present embodiment includes a couple of upper and lower header pipes 6*a* and 6*b*, an upper partitioning wall 13 for partitioning the inner part of the upper header pipe 6*a* into a first upper chamber 15 and a second upper chamber 16, and a lower partitioning wall 14 for partitioning the inner part of the lower header pipe 6*b* into a first lower chamber 17 and a second lower chamber 18. A plural number of heat transfer tubes 7, vertically arranged between the header pipes, are classified into three groups of heat transfer tubes; first heat transfer tubes 19, second heat transfer tubes 20, and third heat transfer tubes 21. The first heat transfer tubes 19 are located most upstream in the direction of a refrigerant current. A refrigerant flows downward through the first heat transfer tubes 19. The second heat transfer tubes 20 are located between the first heat transfer tubes 19 and the third heat transfer tubes 21. The refrigerant flows upward through the second heat transfer tubes 20. The third heat transfer tubes 21 are located most downstream in the direction of a refrigerant current. The refrigerant flows downward through the third heat transfer tubes 21.

The number of the first to third heat transfer tubes 19, 20 and 21 in the condenser 2 is different from that of the heat transfer tubes in the conventional one as shown in FIGS. 15 and 16. Specifically, a total passage area S19 of the first heat transfer tubes 19 is larger than a total passage area S20 of second heat transfer tubes 20. The total passage area S20 of the second heat transfer tubes 20 is equal to or smaller than a total passage area S21 of third heat transfer tubes 21. The first heat transfer tubes 19 allow the refrigerant to flow downward from the first upper chamber 15 to the first lower chamber 17. The second heat transfer tubes 20 allow the refrigerant to flow upward from the first lower chamber 17 to the second upper chamber 16. The third heat transfer tubes 21 allow the refrigerant to flow downward from the second upper chamber 16 to the second lower chamber 18. The relation of those total passage areas S19, S20 and S21 are: S19>S20≦S21.

It is noted here that the total passage area S20 of the second heat transfer tubes 20 for upward flowing of the refrigerant is smaller than the total passage area S19 of the first heat transfer tubes 19 for downward flowing of the refrigerant and equal to or smaller than the total passage area S21 of the third heat transfer tubes 21 for downward flowing of the refrigerant. Therefore, a velocity of flow of the refrigerant flowing through the second heat transfer tubes 20 is increased. And the lubricant that has reached regions at and near to the lower partitioning wall 14 in the lower header pipe 6*b* is fed into the second heat transfer tubes 20, together with the refrigerant. The result is that a necessary amount of the lubricant that is fed, together with the refrigerant, to the compressor is secured, and the durability of the compressor is improved.

6th Embodiment

Figure 8:
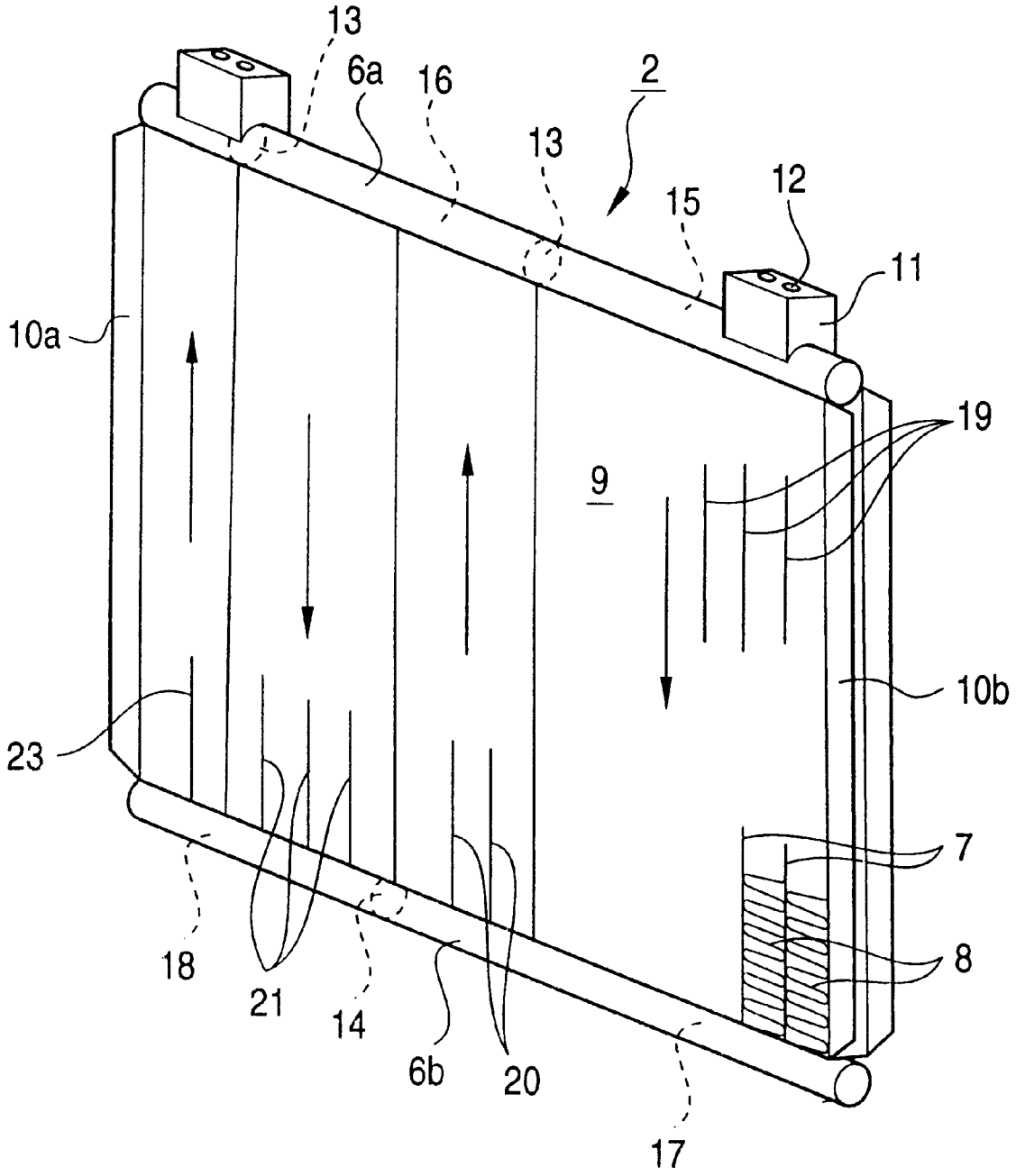
FIG. 8 is a perspective view showing a condenser which is a sixth embodiment of the present invention.

FIG. 8 shows a condenser which is a sixth embodiment of the present invention. In the condenser 2, two upper partitioning walls 13 are used, and the heat transfer tubes 7 comprise four groups of heat transfer tubes; first to fourth group of heat transfer tubes 19, 20, 21 and 23. The fourth group of heat transfer tubes 23 is located downstream of the third group of heat transfer tubes 21 and allows the refrigerant to flow upward. A total passage area S19 of the first group of heat transfer tubes 19 is larger than a total passage area S20 of the second group of heat transfer tubes 20. The total passage area S20 of the second group of heat transfer tubes 20 is equal to or smaller than a total passage area S21 of the third group of heat transfer tubes 21. A total passage area S23 of the fourth group of heat transfer tubes 23 is smaller than the total passage area S21 of the third group of heat transfer tubes 21. A relation among those total passage areas S19, S20, S21 and S23 is: S19>S20≦S21>S23.

Thus, the total passage area S20 of the second group of heat transfer tubes 20 for upward flowing of the refrigerant is smaller than the total passage areas S19 and S21 of the first and third group of heat transfer tubes 19 and 21 for downward flowing of the refrigerant or equal to the total passage area S21. Further, the total passage area S23 of the fourth group of heat transfer tubes 23 for upward flowing is smaller than the total passage area S21 of the third group of heat transfer tubes 21 for downward flowing. Therefore, the lubricant, together with the refrigerant, is efficiently fed into the second and fourth group of heat transfer tubes 20 and 23. The technical idea of the invention is applicable to a case where the number of the lower partitioning walls is increased and the number of the groups of heat transfer tubes 7 forming the core 9 is increased. In this case, the total passage area of each group of the heat transfer tubes for upward flowing is equal to or smaller than that of each group of the heat transfer tubes for downward flowing.

In the condenser thus constructed, an amount of the lubricant (mixed into the refrigerant) staying in the vicinity of the lower partitioning wall is reduced. Therefore, enough lubricant is surely fed u to the compressor to thereby improve the durability of the automobile air conditioner having the compressor assembled therein.

In the fifth and sixth embodiments, it is merely a requirement that a total passage area (number of tubes) of one group of the upward-flow heat transfer tubes is equal to or smaller than a total area (number of tubes) of one group of the downward-flow heat transfer tubes which is located more downstream than the one group of upward-flow heat transfer tubes.

Further, the number of the group of the heat transfer tubes for upward flowing which is located most downward is the smallest among all groups of the heat transfer tubes.

In the above embodiments, the case is described wherein the heat transfer tubes are classified to three or four groups. However, the number of groups is not limited to three or four, and it is possible to apply the present invention to condensers having various number of groups of the heat transfer tubes.

7th Embodiment

Figure 9:
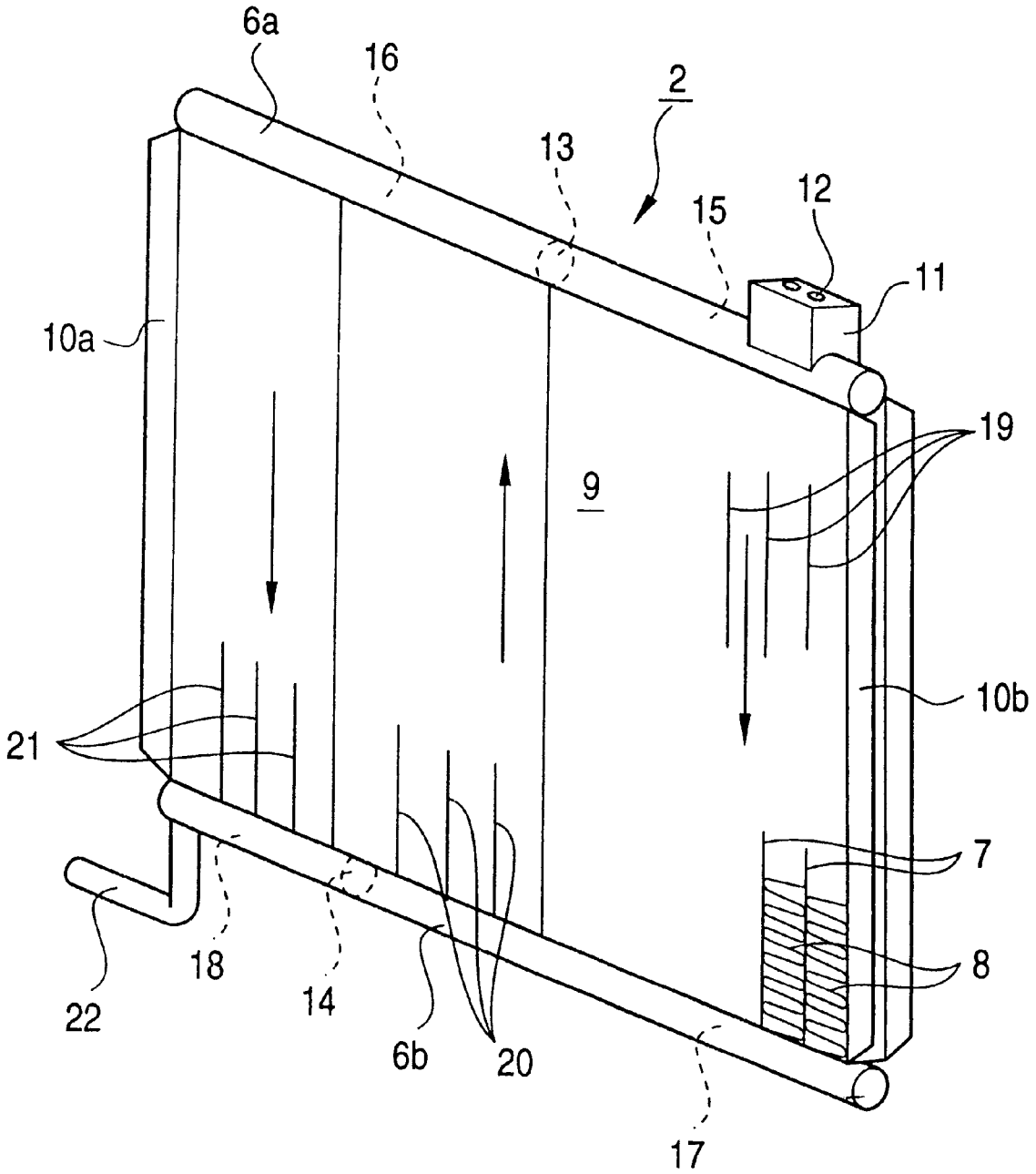
FIG. 9 is a perspective view showing a condenser which is a seventh embodiment of the present invention.

FIG. 9 shows a condenser which is a seventh embodiment of the present invention. The basic construction of a condenser 2 of this embodiment is substantially the same as of the conventional condenser as shown in FIG. 15. The position in the horizontal direction where the outgoing pipe 22, defining an outgoing port in the condenser 2 of the present embodiment, is located is different from that in the conventional condenser as shown in FIG. 15. For simplicity of explanation, description will be given placing emphasis on the different portions of the condenser.

In the condenser 2 of this embodiment, the outgoing pipe 22 defining the outgoing port, as shown in FIG. 9, is provided at a position close to the left end (in FIG. 9) of the lower header pipe 6*b*. The upper end of the outgoing pipe 22 is opened into a portion of the lower header pipe 6*b* which is coupled with the lower ends of the third heat transfer tubes 21 which are located close to the side plate 10*a*. The portion (the left end in FIG. 9) is located most downstream in the direction in which the refrigerant flows in the upper header pipe 6*a*.

In the condenser thus constructed, there is no chance that the liquid refrigerant that has flowed down through the third heat transfer tubes 21 located closer to the center (the right-hand side in FIG. 9) of the core 9, directly reaches the upper end opening of the outgoing pipe 22. The liquid refrigerant flows down, through the third heat transfer tubes 21 located close to the center of the core 9, into the second lower chamber 18, and flows to the left end of the lower header pipe 6*b*. And the liquid refrigerant is mixed with the gaseous refrigerant which has flowed down into the second lower chamber 18, through the third heat transfer tubes 21 located close to the left end of the core 9. Therefore, even if the refrigerant that has reached the second lower chamber 18 is a mixture of the liquid refrigerant and the gaseous refrigerant, there is no chance that only the liquid refrigerant flows into the outgoing pipe 22. The result is that the refrigerant flowing into the outgoing pipe 22 is always a mixture of the liquid refrigerant and the gaseous refrigerant, and that the discharging of the refrigerant out of the condenser is stabilized.

8th Embodiment

Figure 10:
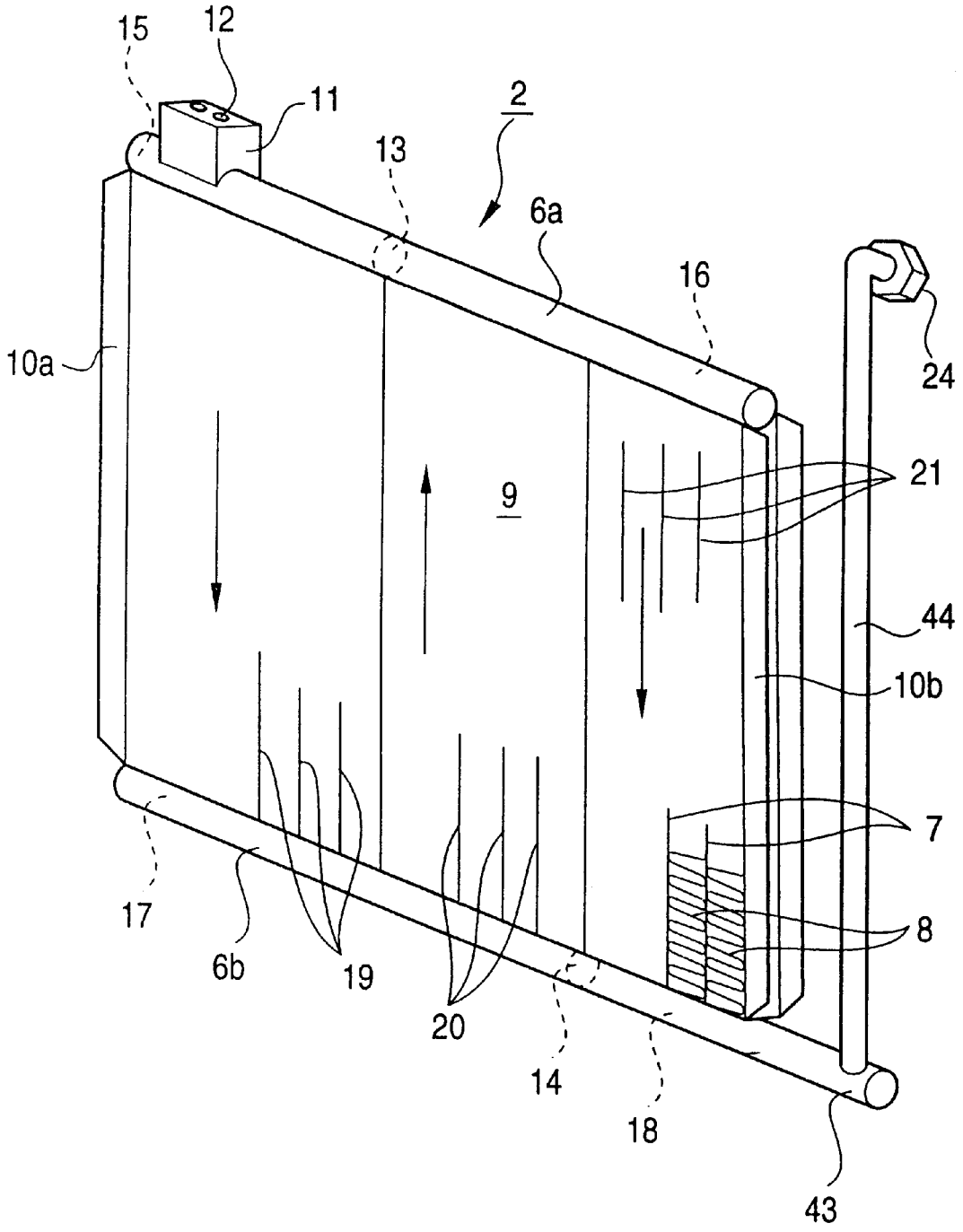
FIG. 10 is a perspective view showing a condenser which is an eighth embodiment of the present invention.

FIG. 10 shows a condenser which is an eighth embodiment of the present invention. In the eighth embodiment, a part of the lower header pipe 6*b* is extended outward beyond the right side (in the figure) of the core 9 to form an extended part 43. The lower end of an outgoing pipe 44 is coupled with the upper surface of the extended part 43. The upper end of the outgoing pipe 44 is opened to form an outgoing port 24.

In the thus constructed condenser 2, as in the seventh embodiment, there is no chance that the liquid refrigerant that has flowed down, through some of the third heat transfer tubes, into the second lower chamber 18 directly reaches the upper end opening of the outgoing pipe 44. Therefore, the condenser 2 of this embodiment prevents liquid only refrigerant from going into the outgoing pipe 44, feeds a mixture of liquid refrigerant and gaseous refrigerant to the outgoing pipe 44, and hence stabilizes the discharging of the refrigerant from the core. In this embodiment, while the refrigerant is discharged from the lower header pipe 6*b*, the outgoing port 24 is provided in the upper part of the condenser 2. This structural feature provides an easy piping and improves a layout freedom of the vapor compression type refrigerator. The remaining construction and operation of the present embodiment are substantially the same as that of the seventh embodiment. However, in the eighth embodiment, the flow direction of the refrigerant is different from the aforementioned embodiments. It is a matter of design, and may properly be selected in accordance with the body structure of an automobile to which the condenser 2 is to be installed.

9th Embodiment

Figure 11:
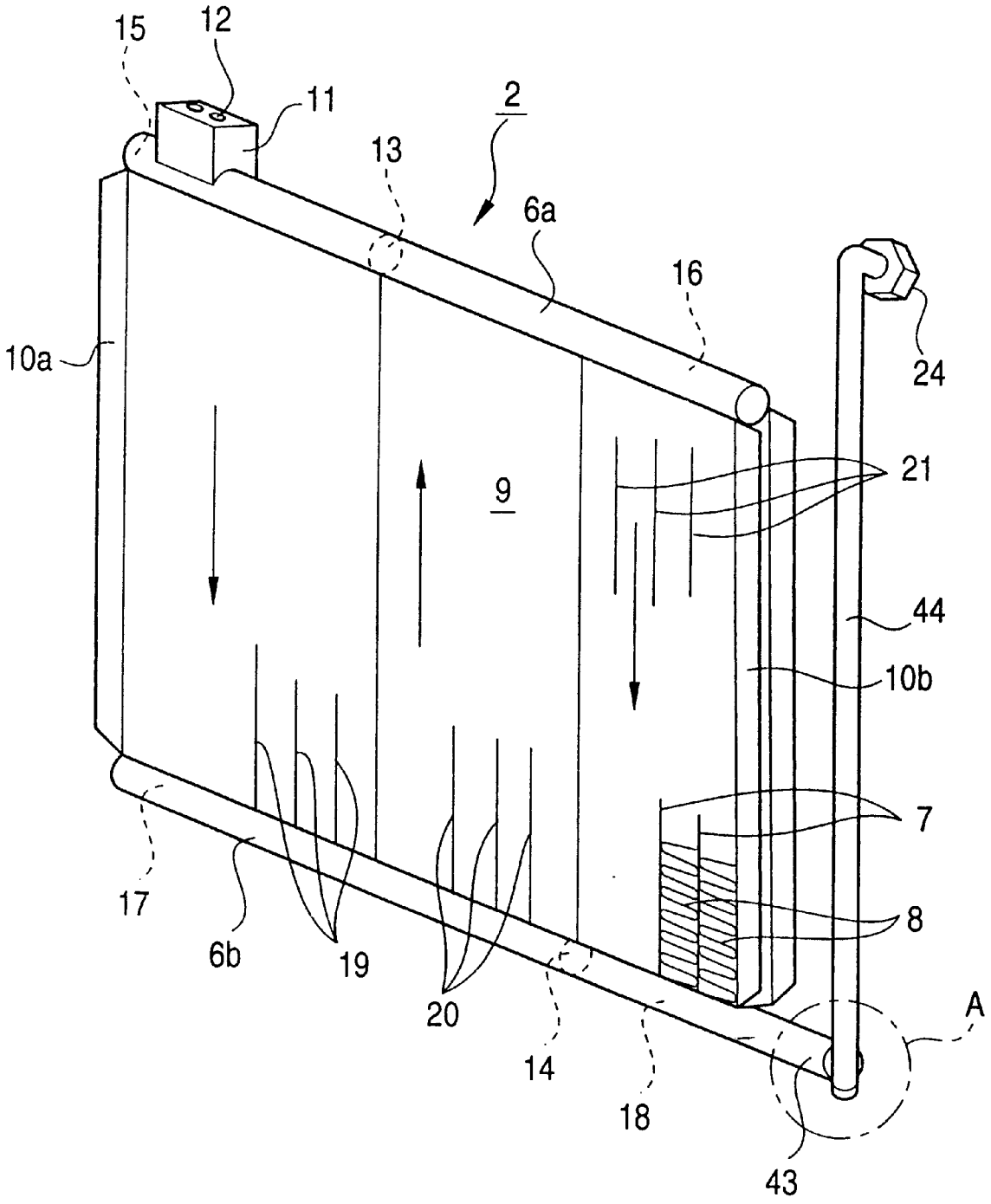
FIG. 11 is a perspective view showing a condenser which is a ninth embodiment of the present invention.
Figure 12:
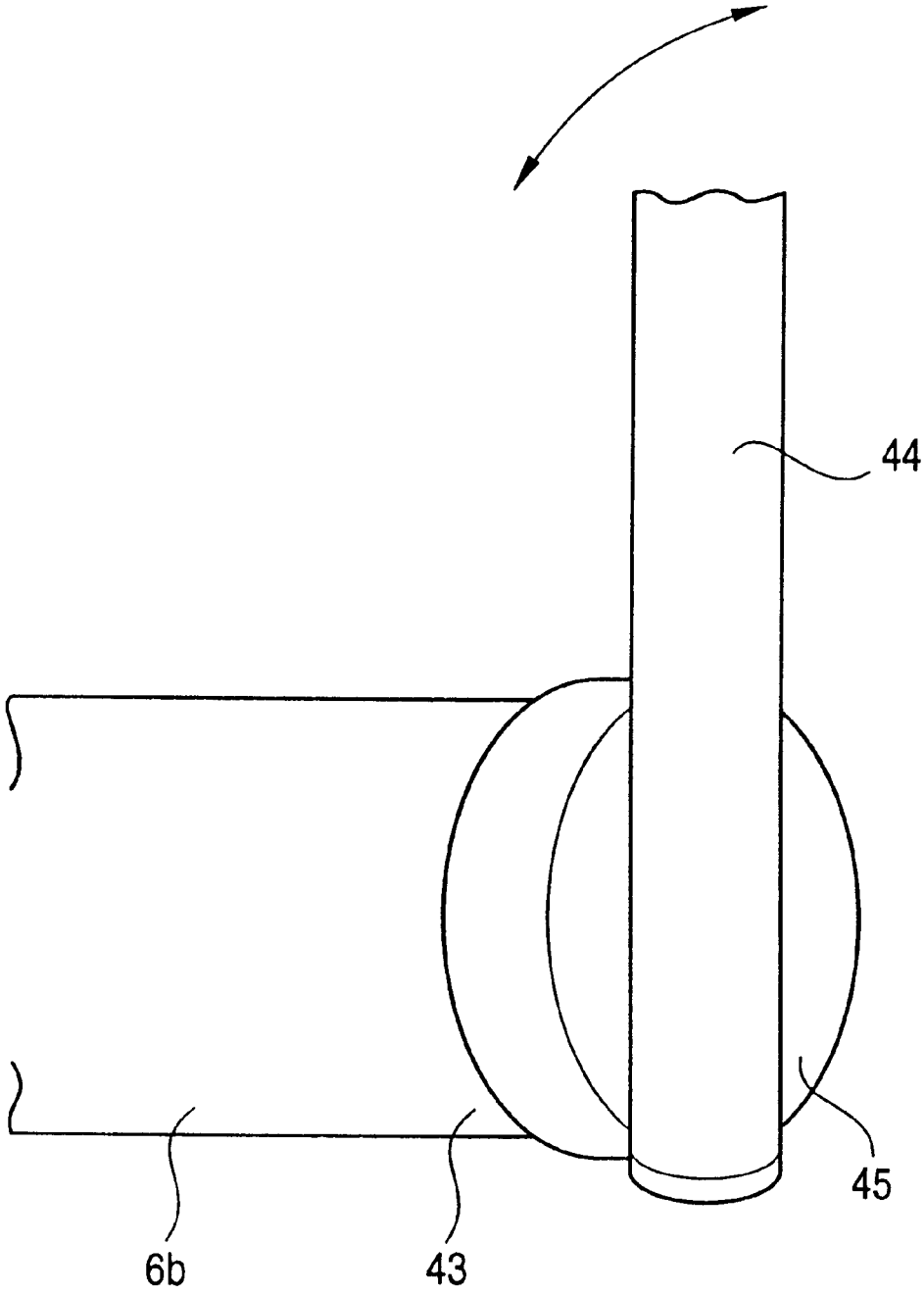
FIG. 12 is an enlarged view showing portion A in FIG. 11.

FIGS. 11 and 12 show a condenser which is an ninth embodiment of the present invention. In the condenser 2 of this embodiment, a part of the lower header pipe 6*b* is extended outward beyond the right side of the core 9 to form an extended part 43, as in the condenser 2 of the eighth embodiment. A cap 45 is attached to the end face of the extended part 43 to close the open end of the same. The lower end of the outgoing pipe 44, defining the outgoing port 24 at the upper end, is coupled with the upper surface of the extended part 43 with the cap 45 intervening therebetween. Specifically, the lower end of the outgoing pipe 44 is applied across the cap 45 while communicating with the lower header pipe 6*b* through the cap 45.

The outer circumferential surface of the lower end of the outgoing pipe 44 is fastened to the end face of the lower header pipe 6*b* in a state that the cap 45 is inserted therebetween. Therefore, the structure of the condenser 2 has a higher rigidity against the forces having the directions of arrows (FIG. 12) than the structure of the eighth embodiment shown in FIG. 10. The remaining construction and operation of the ninth embodiment are substantially the same as that of the eighth embodiment.

10th Embodiment

Figure 13:
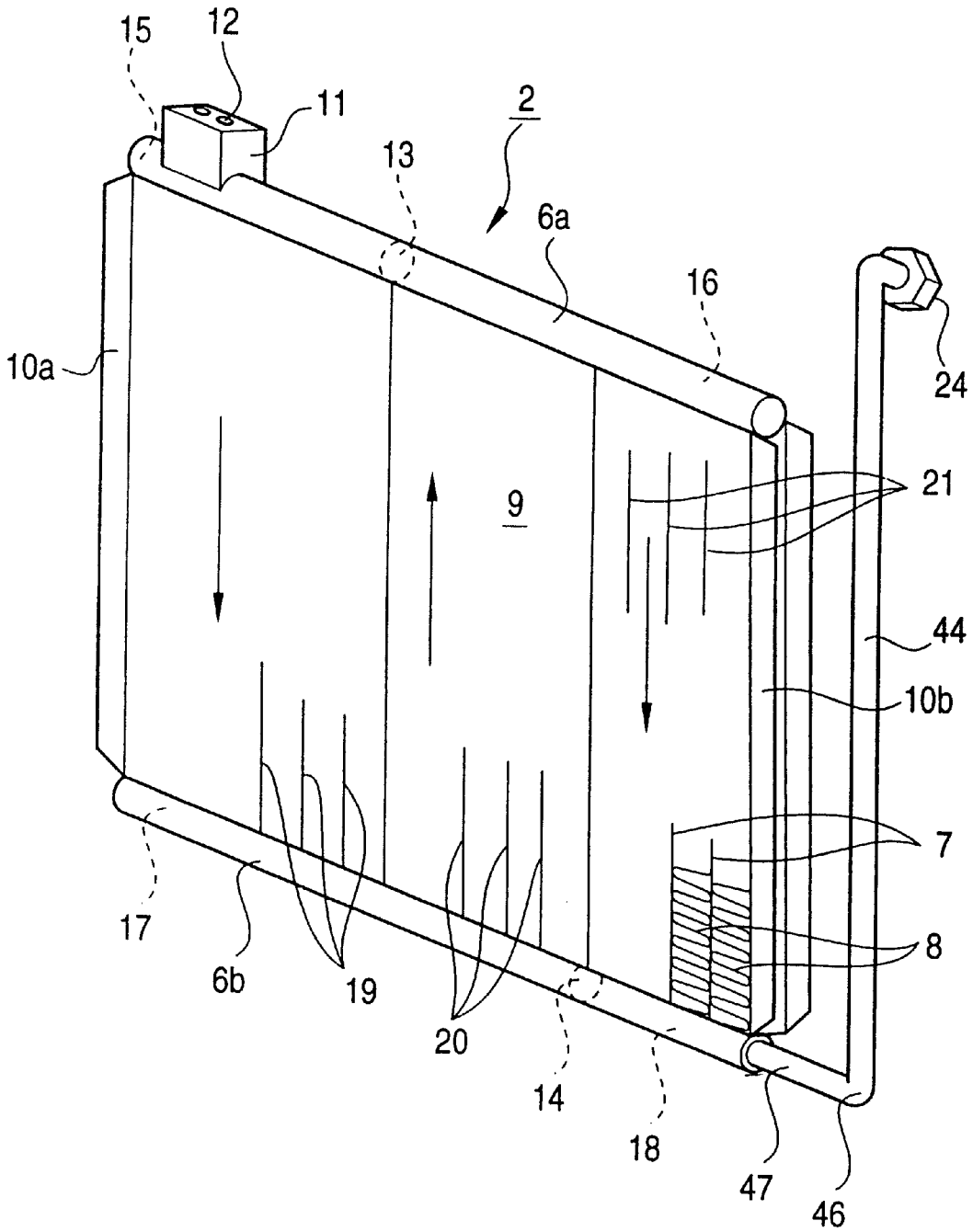
FIG. 13 is a perspective view showing a condenser which is a tenth embodiment of the present invention.

FIG. 13 shows a condenser which is a tenth embodiment of the present invention. In the condenser 2 of this embodiment, a part of the lower header pipe 6*b* is not extended outward beyond the right side of the core 9 to form an extended part 43, unlike the condensers of the eighth and ninth embodiments mentioned above. The lower part of the outgoing pipe 44 is bent to form a corner 46 curved like a ¼ arc, and the curved corner 46 is further extended horizontally and straightforwardly to form a horizontal part 47. The open end of the horizontal part 47 is brazed to the end of the lower header pipe 6*b*. In this condenser, the lower header pipe 6*b* and the outgoing pipe 44, which are different in diameter, are coupled with each other in an end-to-end fashion. To this end, the end of the outgoing pipe 44 having a smaller diameter is flared and the flared end is abutted against the end of the lower header pipe 6*b*. The flared end and the end of lower header pipe 6*b* are bonded to each other by brazing. Alternatively, the end of the lower header pipe 6*b* is reduced in diameter and the reduced end of the same is abutted against the end of the outgoing pipe 44.

The condenser of this embodiment is advantageous in that it is easy to form the connecting part of the lower header pipe 6*b* and the outgoing pipe 44 and, therefore, the cost to manufacture the condenser 2 is reduced. Another advantage of the condenser is that the structure prevents no abrupt change in the refrigerant flow at the connection part, and hence prevents an increase of resistance of the connection part to the refrigerant flow.

The condenser thus constructed and operated is able to stabilize the discharging operation of the refrigerant and to improve the performances of the automobile air conditioner.

The aforementioned embodiments can be combined with two or more auxiliarily embodiments, and it is possible to adopt various combinations of the aforementioned embodiments.

While the invention has been described in detail and with reference to specific examples thereof, it will be apparent to one skilled in the art that various changes and modifications can be made therein without departing from the spirit and scope thereof.

What is claimed is:

1. A condenser assembly structure comprising:

an upper header pipe arranged horizontally;

a lower header pipe arranged parallel to said upper header pipe; and a plural number of heat transfer tubes being arranged vertically between said upper and lower header pipes, upper and lower ends of said heat transfer tubes being opened into inner parts of said upper and lower header pipes, wherein the cross-sectional shape of at least the upper header pipe is substantially circular, and wherein a fluid passage is formed at an upper end of at least one of said heat transfer tubes so that said fluid passage does not extend over the entire periphery of said one of said heat transfer tubes, said fluid passage is located below said upper end of said heat transfer tube and just above an inner bottom portion of said upper header pipe so as to guide a fluid staying at the inner bottom portion of said upper header pipe into said heat transfer tube.

2. The condenser assembly structure according claim 1, wherein said fluid passage is a cutout formed being extended from said upper end of said heat transfer tube to just above the inner bottom portion of said upper header pipe.

3. The condenser assembly structure according claim 1, wherein said fluid passage is a through-hole formed between said upper end of said heat transfer tube and just above the bottom portion of said upper header pipe.

* * * * *